US006098677A

United States Patent [19]

Wegman et al.

[11] Patent Number: 6,098,677

[45] Date of Patent: Aug. 8, 2000

[54] HIGH SPEED AIR NOZZLE WITH MECHANICAL VALVE FOR PARTICULATE SYSTEMS

[75] Inventors: Paul M. Wegman, Pittsford; Mikhail Vaynshteyn, Rochester; Timothy L. Huss, Walworth, all of N.Y.

[73] Assignee: Xerox Corporation, Stamford, Conn.

[21] Appl. No.: 09/394,201

[22] Filed: Sep. 10, 1999

[51] Int. Cl.[7] ..... B67C 3/26

[52] U.S. Cl. ..... 141/256; 141/286

[58] Field of Search ..... 141/256, 286, 141/39, 47, 44, 93

[56] References Cited

U.S. PATENT DOCUMENTS

| | | | |
|---|---|---|---|
| 2,524,560 | 10/1950 | Cote | 226/25 |
| 3,664,385 | 5/1972 | Carter | 141/12 |
| 4,185,669 | 1/1980 | Javakohoff | 141/59 |
| 4,561,759 | 12/1985 | Knott | 355/3 DD |
| 4,650,312 | 3/1987 | Vineski | 355/15 |
| 4,932,355 | 6/1990 | Neufeld | 118/652 |
| 4,974,646 | 12/1990 | Martin et al. | 141/67 |
| 4,976,296 | 12/1990 | Pope | 141/46 |
| 4,977,428 | 12/1990 | Sakakura et al. | 355/245 |
| 4,987,951 | 1/1991 | Dietrich et al. | 164/466 |
| 5,095,338 | 3/1992 | Hayes, Jr. et al. | 355/246 |
| 5,337,794 | 8/1994 | Hishiyama et al. | 141/144 |
| 5,438,396 | 8/1995 | Mawdesley | 355/260 |
| 5,531,253 | 7/1996 | Nishiyama et al. | 141/90 |
| 5,598,876 | 2/1997 | Zanini et al. | 141/93 |
| 5,655,690 | 8/1997 | DeGoler et al. | 141/256 |
| 5,685,348 | 11/1997 | Wegman et al. | 141/2 |
| 5,711,353 | 1/1998 | Ichikawa et al. | 141/67 |
| 5,727,607 | 3/1998 | Ichikawa et al. | 141/67 |
| 5,762,117 | 6/1998 | Law | 141/286 |
| 5,839,485 | 11/1998 | Wegman et al. | 141/129 |

*Primary Examiner*—David J. Walczak

[57] ABSTRACT

An apparatus and method for supplying particulate material from a hopper is disclosed. A conduit is operably connected to the hopper and extends downwardly therefrom, the conduit permitting a flow of particulate material therewithin in a supplying operation. A nozzle assembly is connected to the conduit and extending downwardly therefrom. The nozzle assembly defines an inlet thereof for receiving particulate material from the conduit and defines an outlet thereof for dispensing particulate material from the nozzle assembly. A conveyor within the conduit assists in providing the flow of particulate material through the conduit. Within the nozzle assembly is a porous nozzle with dimensions selected so as to provide a ratio of the inlet cross-sectional area to the outlet cross-sectional area and selection and application of an air boundary layer to the inner surface of the porous nozzle to maximize the porous nozzle's compression ratio such that the flow of particulate material does not seize as it progresses through the nozzle. The nozzle assembly is part of a mechanical valve, the nozzle assembly being slidably supported with respect to the conduit. The slidable nozzle assembly moves up and down with respect to a flow control device to respectively open and close the valve. In the closed position the flow control device blocks the flow of particulate material from the nozzle assembly and in the open position the flow control device allows particulate material to flow from the nozzle assembly.

20 Claims, 17 Drawing Sheets

HIGH SPEED AIR NOZZLE WITH MECHANICAL VALVE FOR PARTICULATE SYSTEMS

This patent application related to U.S. Ser. No. 09/299,773 entitled "High Speed Nozzle for Particulate Filling System", filed Apr. 26, 1999, which in turn is a Continuation-In-Part of U.S. Ser. No. 08/923,016 entitled "High Speed Nozzle for Toner Filling Systems", filed Sep. 3, 1997, both of which are assigned to the same assignee as the present invention. This invention relates generally to filling a container with material, and more particularly concerns a fill nozzle with an air boundary layer for controlling the flow of particulate materials such as toner from a fill tube to a toner container.

Currently when filling particulate materials, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner/funnel friction. High auger speed will cause the toner to melt, particularly for low melt toner such as disclosed in U.S. Pat. No. 5,227,460 to Mahabadi et al. the relevant portions thereof incorporated herein by reference.

To provide for productive efficient toner containers, typically, the rotating augers used to transport the toner from hoppers are relatively large. The large augers provide for high volume toner flow and thus improve productivity in a fill line. When utilizing such fill lines for small, low cost copiers and printers, difficulties occur in that the openings in the toner containers utilizing such small copiers and printers include a small toner fill opening that may have an irregular shape and have a fill opening that is not centrally located in the container. Problems are thus associated with fitting the large filling tubes and augers with the small toner fill openings.

Problems with filling containers with toner are exacerbated in that the small low cost copies are produced in higher quantities necessitating very efficient toner filling operations.

Problems with efficient toner filling are also apparent in small and medium cost multi-colored highlight or full color printers and copiers. The toner containers for color toner typically are smaller than those for black toner and also more typically have an irregular shape. Further, color toners have been developed with smaller particle size of for example 7 microns or less. These smaller toners are more difficult to flow through toner hoppers and are more difficult to be translated along augers.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely fill the remote portions of the container before the container overflows.

The problems associated with controlling the filling of toner containers are due primarily to the properties of the toner. Toner is the image-forming material in a developer which when deposited by the field of an electrostatic charge becomes the visible record. There are two different types of developing systems known as one-component and two-component systems.

In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier which consists of roughly spherical particles or beads usually made of steel. An electrostatic charge between the toner and the carrier bead causes the toner to cling to the carrier in the development process. Control of the flow of these small, abrasive and easily charged particles is very difficult.

The one-component and two-component systems utilize toner that is very difficult to flow. This is particularly true of the toner used in two component systems, but also for toner for single component systems. The toner tends to cake and bridge within the hopper. This limits the flow of toner through the small tubes which are required for addition of the toner through the opening of the toner container. Also, this tendency to cake and bridge may cause air gaps to form in the container resulting in partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to cloud causing dirt to accumulate around the filling operation.

Also, difficulties have occurred in quickly starting and stopping the flow of toner from the hopper when filling the container with toner in a high-speed production filling operation. An electromagnetic toner valve has been developed as described in U.S. Pat. Nos. 5,685,348 and 5,839,485. The electromagnetic valve is limited for use with magnetizable toner such as that described for use with one component development systems.

Attempts have been made to fill toner containers having small toner fill openings by utilizing adapters positioned on the end of the toner filling auger which has an inlet corresponding to the size of the auger and an outlet corresponding to the opening in the toner container. Clogging of the toner, particularly when attempting to increase toner flow rates and when utilizing toners with smaller particle size, for example, color toners having a particle size of 7 microns or less, has been found to be a perplexing problem. The adapters that are fitted to the augers, thus, tend to clog with toner. The flow rates through such adapters is unacceptably low.

Further, the use of these adapters may create problems with maintaining a clean atmosphere free of toner dust at the filling operation.

The following disclosures may be relevant to various aspects of the present invention:

---

US-A 5,337,794
Patentee: Nishiyama et al.
Issue Date: August 16, 1994
US-A 5,438,396
Patentee: Mawdesley
Issue Date: August 1, 1995
US-A 5,095,338
Patentee: Hayes, Jr. et al.
Issue Date: March 10, 1992
US-A 4,977,428
Patentee: Sakakura et al.

-continued

| |
|---|
| Issue Date: December 11, 1990 |
| US-A 4,932,355 |
| Patentee: Neufeld |
| Issue Date: June 12, 1990 |
| US-A 4,650,312 |
| Patentee: Vineski |
| Issue Date: March 17, 1987 |
| US-A 4,561,759 |
| Patentee: Knott |
| Issue Date: December 31, 1985 |
| US-A 5,531,253 |
| Patentee: Nishiyama et al. |
| Issue Date: July 2, 1996 |

The relevant portions of the foregoing disclosures may be briefly summarized as follows:

U.S. Pat. No. 5,337,794 describes a powder filling apparatus and a method for filling a container with powder. The toner container is filled by conveying toner from a supply hopper through a nozzle with a valve on the end. The valve is disposed at the bottom opening of the nozzle to release and close the opening of the nozzle by the vertical movement of the valve element.

U.S. Pat. No. 5,438,396 is drawn to a toner anti-dribble device which is attached to a toner container having a vertical fill tube and a rotatable auger for feeding toner into a toner container. The toner anti-dribble device also has a sleeve member engageable with the fill tube. A plurality of flexible insertion wires are inserted through the sleeve member into the toner container and disposed substantially perpendicular to the insertion direction of the toner. The arrangement of the wires positively prevents toner dribble between fills while being flexible enough to flex in proportion to the fill rate, which prevents fusing of the toner on the wires.

U.S. Pat. No. 5,095,338 teaches a developer which discharges used carrier particles using a magnetic valve. Discharge of developer material from the developer housing is controlled by a permanent magnet and an electromagnet positioned adjacent an exit port in the developer housing. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted to it is discharged.

U.S. Pat. No. 4,977,428 discloses an electrographic printer having a pulse motor for driving a conveyor. The conveyor is built into the developer unit. The conveyor is controlled during the initialization process of the apparatus by setting the rotational speed of the motor at a lower level upon startup of the motor. The lower speed results in higher torque to overcome solidification of the toner.

U.S. Pat. No. 4,932,355 discloses a method for removing a developer mix from a developing station with a magnetic closing device which is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

U.S. Pat. No. 4,650,312 discloses a structure for minimizing bridging or packing of toner in the flights of an auger of a toner removal and collection system. The toner anti-bridging structure includes a pendulum which is caused to periodically bang into the auger to create vibrations in the auger structure.

U.S. Pat. No. 4,561,759 discloses a device for filling and filtering toner from a supply container. A filter basket is disposed in the region of the filling opening which is closed from the feed container by a filter mesh and an electric vibrator connected thereto by a linkage which can be automatically triggered at the beginning of a filling operation.

U.S. Pat. No. 5,531,253 discloses a cleaner for cleaning the nozzle portion of a powder filling apparatus by equally evacuating the inside and the outside of the container and dropping powder through the nozzle portion into the container simultaneously with the raising the pressure outside the container.

U.S. Pat. No. 5,839,485, issued Nov. 24, 1998, entitled "Electromagnetic Valve and Demagnetizing Circuit", by Wegman et al., which is assigned to the same assignee as this application, teaches a method and apparatus for filling a container with a magnetic material using an electromagnetic valve and a demagnetizing circuit to control the flow and properties of the material. In the filling process an auger located inside of the fill tube rotates and moves the material through the fill tube. When the container is filled, the auger stops rotating and the electromagnetic valve is actuated. The electromagnetic valve supplies a magnetic field which holds the material in place, plugging the fill tube with the material as the container is removed and a new container is placed to be filled. When the electromagnetic valve is switched off, a demagnetizing circuit is activated. After the material is demagnetized the auger is switched on and the material flows again to fill the container.

U.S. Pat. No. 5,685,348, issues Nov. 11, 1997, entitled "Electromagnetic Filler for Developer Material" and is assigned to the same assignee as this application, teaches a method and apparatus for filling a container with toner using a series of traveling magnetic fields to control the flow of toner from a supply of toner to the container. Initially, an empty container is placed under a fill tube through which the toner will be supplied to the container. In the filling process the traveling magnetic fields, which are supplied by turning on and off a series of solenoids, and gravity cause toner from the toner supply to move through the fill tube. When a solenoid is turned on toner particles are attracted to its magnetic field where a plug of toner is formed. The solenoids are controlled so that a discrete amount of toner is supplied in each on/off cycle of the solenoids. The solenoid on/off cycle is repeated until the container is filled with toner. When the container is filled, the appropriate solenoid is activated so that a plug of toner stops the flow of toner in the fill tube. The filled container is removed from the fill tube and an empty container is put in its place so that the solenoid on/off cycle may begin again.

U.S. patent application Ser. No. 08/829,925 filed Apr. 1, 1997, entitled "Oscillating Valve for Powders", Wegman et al., which is assigned to the same assignee as this application, teaches a method for filling a powder container. The method includes the steps of placing a first powder container to be filled in filling relationship to a discharge feature in the vessel, directing the powder in the vessel toward a member located at least partially within the vessel, the member defining a restriction therein such that the powder clogs within the restriction, mechanically exciting the powder at least adjacent the restriction to improve the flow properties of the powder so as to unclog the powder within the restriction, dispensing powder through the restriction, through the discharge feature and into the first container, stopping the mechanical excitation of the powder so as to clog the restriction with the powder, removing the first container from the vessel, and placing a second container to be filled in filling relationship to the vessel.

U.S. patent application Ser. No. 08/823,034 filed Apr. 1, 1997, entitled "Vibratory Filler for Powders", Wegman et al., which is assigned to the same assignee as this application, teaches a method for filling a powder container. The method includes the steps of placing a first powder container to be filled in filling relationship to a supply of powder in a vessel, mechanically exciting the powder in the vessel to improve its flow properties, dispensing powder from the vessel into the first container, removing the first container from the vessel, and placing a second container to be filled in filling relationship to the vessel.

U.S. Pat. No. 4,185,669 to Javakohoff teaches a method and apparatus for filling a receptacle with powder having a filter and suction source that provides for air to be sucked from the powder filling the receptacle while preventing powder from being sucked into the suction source.

U.S. Pat. No. 5,598,876 to Zanini et al. teaches a powdered material dispensing unit having a gravity dispensing unit for filling containers with powdered material. A porous nozzle has compressed air supplied thereto and a shutter stops the flow of the powdered material between filling operations. A vacuum source keeps the powdered material contained.

U.S. Pat. No. 4,974,646 to Martin et al. discloses a powder flow control valve with a porous nozzle having a positive pressure air source and a negative pressure air source attached thereto. During the powder filling operation, positive pressure air source is supplied to the porous nozzle. When the filling operation is completed, the negative pressure air source is substituted for the positive pressure air source to stop the flow of powder in the porous nozzle.

U.S. Pat. No. 4,976,296 to Pope teaches a filling machine for filling containers with particulate material using a nozzle having an outlet end for delivery of particulate material to a container. The nozzle is encircled by a downwardly facing seal to engage the upper open end of the container. The nozzle has an outer annular cavity terminating in an annular port around the open end of the nozzle in which a relatively high vacuum is drawn to evacuate the container and draw material through the passageway into the container. The nozzle has an inner annular cavity terminating in a porous wall encircling the discharge end of the nozzle in which a relatively low vacuum is drawn to adhere material in the nozzle to the wall to terminate flow through the nozzle.

U.S. Pat. Nos. 5,711,353 and 5,727,607, both to Ichikawa et al. teach powder filling methods and devices. In both references, the step of injecting a gaseous medium from a porous wall forming a funnel in the bottom end of a hopper into the powder material held in the hopper is taught. The gaseous medium is carried out intermittently to assist in controlling the flow of powder through the device.

U.S. patent application Ser. Nos. 09/039,804 filed Mar. 16, 1998, entitled "Apparatus for Particulate Processing", Wegman et al., and U.S. patent application Ser. Nos. 09/061,122 filed Apr. 16, 1998, entitled "Apparatus for Particulate Processing", Wegman et al., both of which are assigned to the same assignee as this application, teach other methods for filling powder containers.

U.S. patent application Ser. Nos. 09/173,415 filed Oct. 15, 1998, entitled "Particulate Processing Apparatus", Wegman et al., and U.S. patent application Ser. Nos. 09/173,395 filed Oct. 15, 1998, entitled "Particulate Processing Apparatus", Wegman et al., both of which are assigned to the same assignee as this application, teach other methods for filling powder containers where a porous nozzle with an air boundary layer is used.

All of the above references are hereby incorporated by reference.

SUMMARY OF THE INVENTION

The present invention is drawn to an apparatus for moving a supply of particulate material from a hopper. The apparatus includes a conduit operably connected to the hopper and extending downwardly therefrom, the conduit adapted to permit a flow of particulate material therewithin, the particulate material in the hopper having a hopper bulk density; a nozzle assembly operably connected to the conduit and extending downwardly therefrom, the nozzle assembly having a nozzle assembly inlet and a nozzle assembly outlet; a porous nozzle within the nozzle assembly, the porous nozzle defining an inlet thereof for receiving particulate material from the conduit and defining an outlet thereof for dispensing particulate material from the porous nozzle, the inlet defining an inlet cross sectional area and the outlet defining an outlet cross sectional, the inlet cross sectional area being larger than the outlet cross sectional area, and defining an inner periphery thereof; a layer of air between the inner periphery and the flow of particulate material, the layer of air being supplied by a compressed air source, wherein the layer of air reduces the friction between the particulate material and inner periphery, the particulate material having an exit bulk density as it leaves the nozzle assembly outlet. A conveyor is located at least partially within the conduit, the conveyor assisting in providing the flow of particulate material, wherein the dimensions of the porous nozzle are selected so as to provide a ratio of the inlet cross sectional area to the outlet cross sectional area and the layer of air is controlled such that the flow of particulate material does not seize as it progresses through the nozzle assembly during particulate supplying operations and the hopper bulk density and exit bulk density are substantially the same. A mechanical valve controls the flow of particulate material from the nozzle assembly.

Another aspect of the present invention is drawn to a method of supplying a predetermined amount of particulate material from a hopper. The method includes locating a conduit to extend from the hopper, the particulate material in the hopper having a hopper bulk density; conveying with a conveyor the particulate material in the hopper toward a nozzle assembly attached to the conduit, the nozzle assembly having a porous nozzle with an inlet cross sectional area defining an inlet cross sectional area and an outlet defining an outlet cross sectional area and the porous nozzle having an inner periphery thereof; sizing the inlet cross sectional to be larger than the outlet cross sectional area. An air boundary is applied to the inner periphery of the porous nozzle to increase the compression ratio of the porous nozzle such that the flow of particulate material does not seize as it progresses through the nozzle assembly; the particulate material is dispensed through the conduit with the conveyor through the nozzle assembly during a supplying operation, the particulate material having an exit bulk density as it leaves the nozzle assembly, wherein the particulate material hopper bulk density is substantially the same as the exit bulk density; and the flow of particulate material from the nozzle assembly is controlled with a mechanical valve.

DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
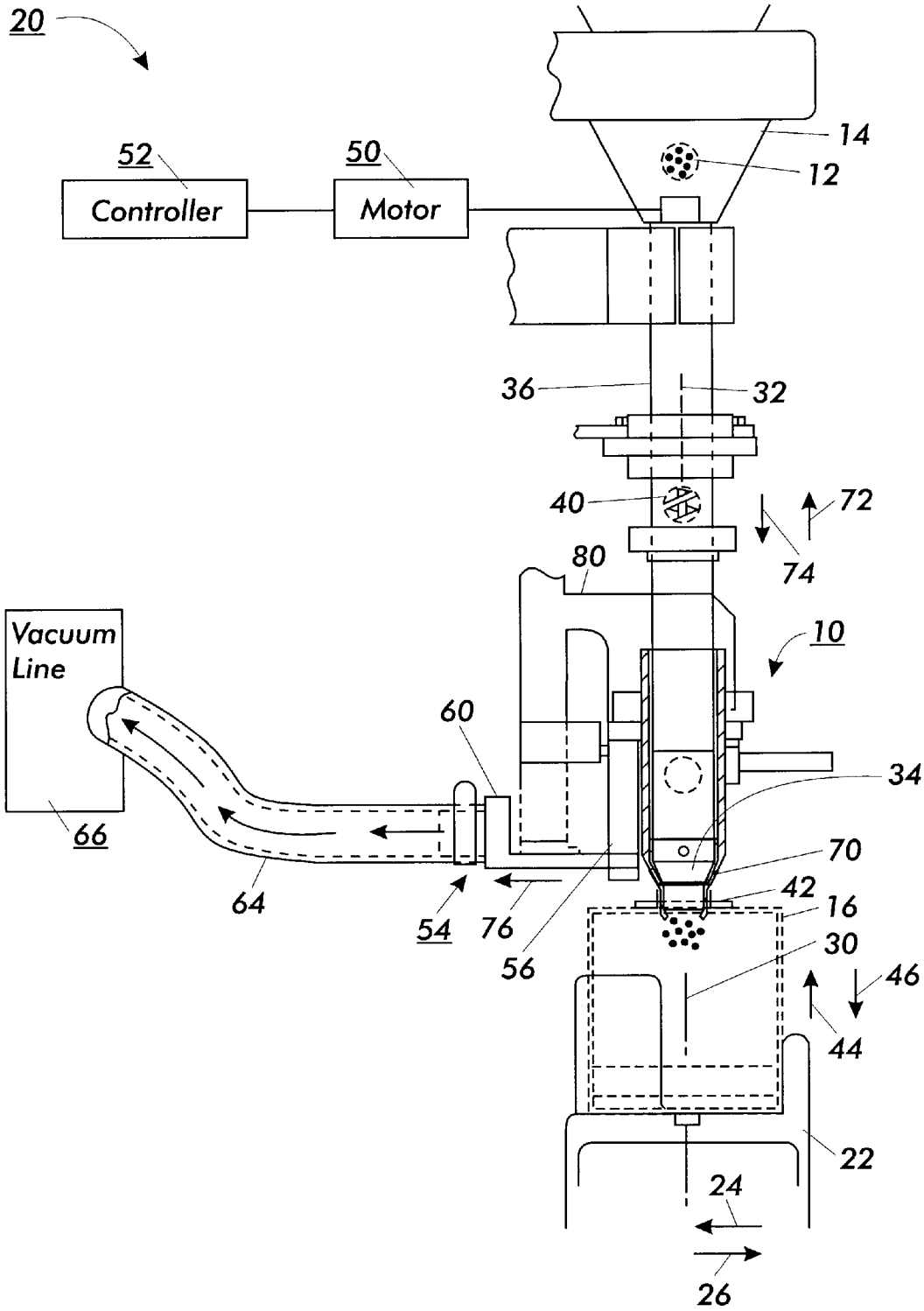
FIG. 2 is an elevational view of a container filling system partially in section utilizing the nozzle of FIG. 1 showing the deflector in use to disperse the developer material with the filling system in the filling position.

According to the present invention and referring now to FIG. 2, powder filling assisting apparatus 10 is shown. The powder filling assisting apparatus 10 is used to convey powder 12 in the form of toner for use in a copier or printer from a hopper 14 to a container 16. The powder filling apparatus 10 is mounted to filling line 20 preferably to permit for the filling of large production quantities of containers 16, the container 16 is preferably mounted to a carrying device 22. The device 22 is movable in the direction of either arrow 24 or 26. The carrying device 22 serves to position container centerline 30 in alignment with apparatus centerline 32.

The powder filling assisting apparatus 10 includes a nozzle 34 which is used to direct the powder 12 into the container 16. The nozzle 34 is connected to the hopper 14 by means of a conduit 36 preferably in the form of a hollow tube or funnel.

As shown in FIG. 2, the hopper 14 is positioned above the container 16 whereby gravity will assist in the flow of powder 12 toward the container 16. To optimize the flow of powder 12 toward the container 16, the powder filling apparatus 10 further includes a conveyor 40 positioned at least partially within the conduit 36 for assisting in the flow of the powder 12. The conveyor 40 is preferably in the form of a spiral conveyor or auger. For example, the auger 40 may be in the form of a spiral shaped auger, which may include various geometries, such as, a straight or tapered helical screw. Preferably the auger closely conforms to the conduit.

Preferably, the nozzle 34 is insertable into opening 42 of the container 16. The insertion of the nozzle 34 in the opening 42 may be accomplished in any suitable method. For example, the carrying device 22 and, consequently, the container 16 may be movable upward in the direction of arrow 44 for engagement with the nozzle 34 and downward in the direction of arrow 46 for disengagement from the opening 42. The upward and downward motion of the device 22 and the container 16 permits the container 16 to be indexed in the direction of arrows 24 and 26.

To permit the filling of a number of containers 16, the flow of powder 12 from the hopper 14 must be halted during the indexing of a filled container 16 from the fill position and during the indexing of the unfilled container 16 toward the filling position. As shown in FIG. 2, the flow of powder 12 may be halted by the stopping of auger 40 within the conduit 36. The auger 40 may be rotated by any suitable method, i.e. by motor 50 operably connected to the auger 40. The motor 50 is connected to a controller 52 which sends a signal to the motor 50 to stop the rotation of the auger 40 during indexing of the carrying device 22. It should be appreciated, however, that the flow of powder 12 through the conduit 36 may be further controlled by the use of a valve (not shown).

Preferably, provisions are made to assure that the filling line 20 is free from airborne powder 12 which may escape between the nozzle 34 and the opening 42 of the container 16 during the filling operation and in particular during the indexing of the carrying device for presenting an unfilled container 16 to the powder filling apparatus 10. A clean filling system 54 is shown in FIG. 2 for use with the apparatus 10. The clean filling system 54 preferably includes housing 56. The housing 56 is secured to filling line 20 as well as to the conduit 36.

The housing 56 may serve several purposes. For example, the housing 56 may be used to support slide 60. Slide 60 is connected to a tray 61 which slidably is fitted between the nozzle 34 and the opening 42. The tray 61 may have any suitable form and, as shown in FIG. 2 may be in the form of a toner drip plate. The tray 61 has a first position in which the tray 61 prevents the powder 12 from exiting the nozzle 34. In this extended position, the tray 61 prevents the spilling of powder 12 during the indexing of the containers 16. The tray 61 also has a second retracted position for permitting the powder 12 to flow into the container 16 during filling. The housing 56 preferably also provides a second purpose, namely, to support the conduit 36 and the nozzle 34.

Also, the housing 56 surrounds the nozzle 34 and provides a cavity or chamber 62 which is sealed when the tray 61 is in its closed position. The chamber 62 preferably is kept at a vacuum. The chamber may be maintained at a vacuum in any suitable fashion, e.g. the chamber 62 may be connected by toner dust vacuum line 64 to vacuum source 66. The vacuum source 66 may be in the form of a toner recovery booth.

The housing 56 also may preferably provide an additional function. The housing 56 serves as a registration guide for guiding the nozzle 34 into the opening 42. As shown in FIG. 2, the housing 56 includes a chamfered end 70 which as the container 16 moves in the direction of arrow 44, contacts the opening 42 to register and align the powder filling assisting apparatus 10 with the container 16. Preferably, the housing 56 is slidably mounted to the conduit 36 such that the housing 56 may move upwardly in the direction of arrow 72 and downwardly in the direction of arrow 74. It should be appreciated that the sliding motion of the housing 56 may be accomplished by gravity or by springs as well as by a motor or other mechanism. For example, the housing 56 may be moved upwardly in the direction of arrow 72 by the container 16 moving upwardly in the direction of arrow 44. The nozzle 34, thereby, enters into the opening 42 permitting filling.

Concurrently with the raising of the container 16 to engage with the nozzle 34, the tray 61 is moved to the left in the direction of arrow 76 to permit the powder 12 to flow through the nozzle 34 and into the container 16. It should be appreciated that the tray 61 may be actuated in any manner, for example, by means of a motor or other mechanism, but, as shown in FIG. 2, the tray 61 is preferably operated by a cam mechanism 80 interconnected to the housing 56 such that when the housing 56 moves in the direction of arrow 72, the tray 61 moves in the direction of arrow 76 opening the chamber 62 to communication with the container 16.

FIG. 2 shows the powder filling assisting apparatus 10 in the container up position to enable filling of the container 16. The nozzle 34 is positioned in the opening 42 of the container and the tray 61 is retracted in the position of arrow 76 to permit the flow of toner 12.

Figure 3:
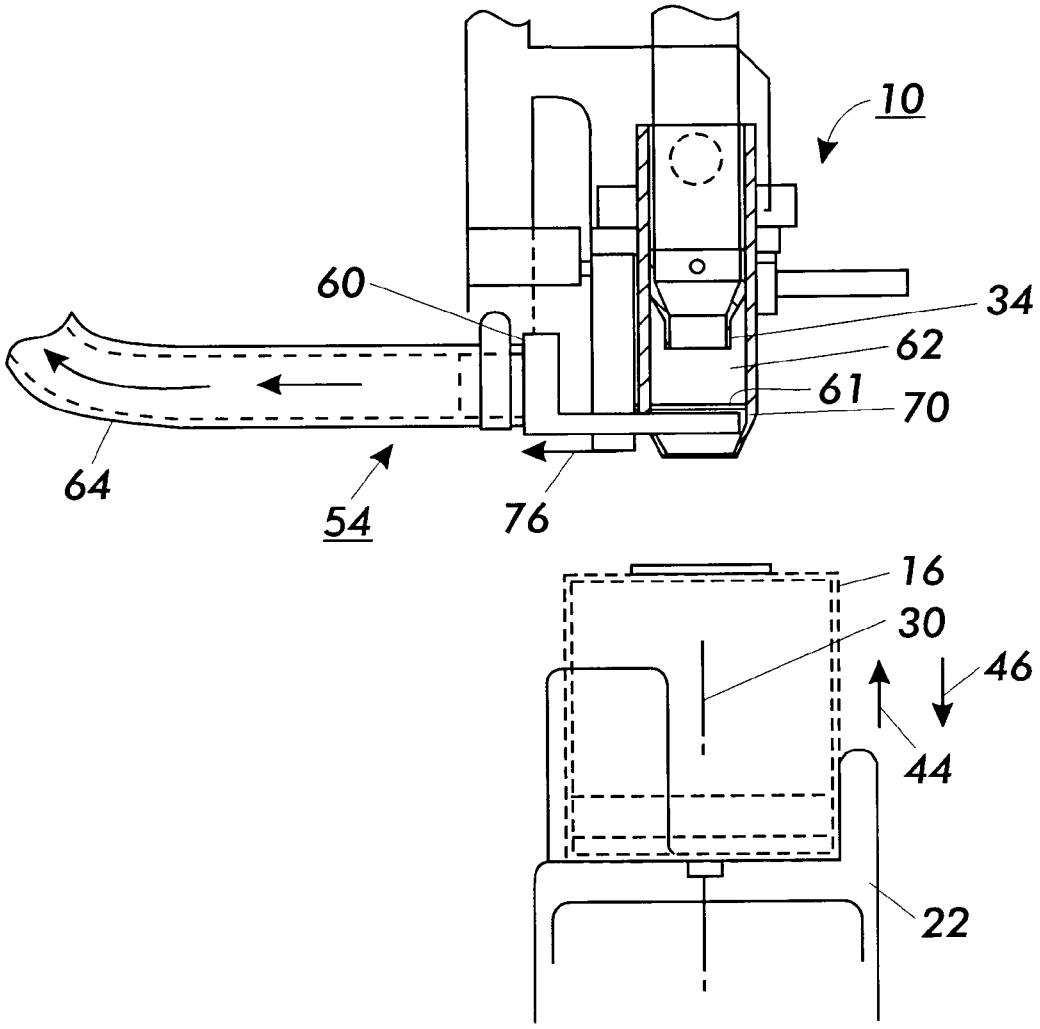
FIG. 3 is a elevational view of a container filling system partially in section utilizing the nozzle of FIG. 1 showing the deflector in use to disperse the developer material with the filling system in the indexing position.

Referring now to FIG. 3, the powder filling assisting apparatus 10 is shown with in the container down position to enable indexing of the carrying device 22. The carrying device 22 indexes the filled container out of the fill position and indexes the unfilled container into the fill position. The nozzle 34 is removed from the opening 42 of the container 16 in this position. The tray 61 is extended into the chamber 62 to catch any dripping toner residue.

Figure 1:
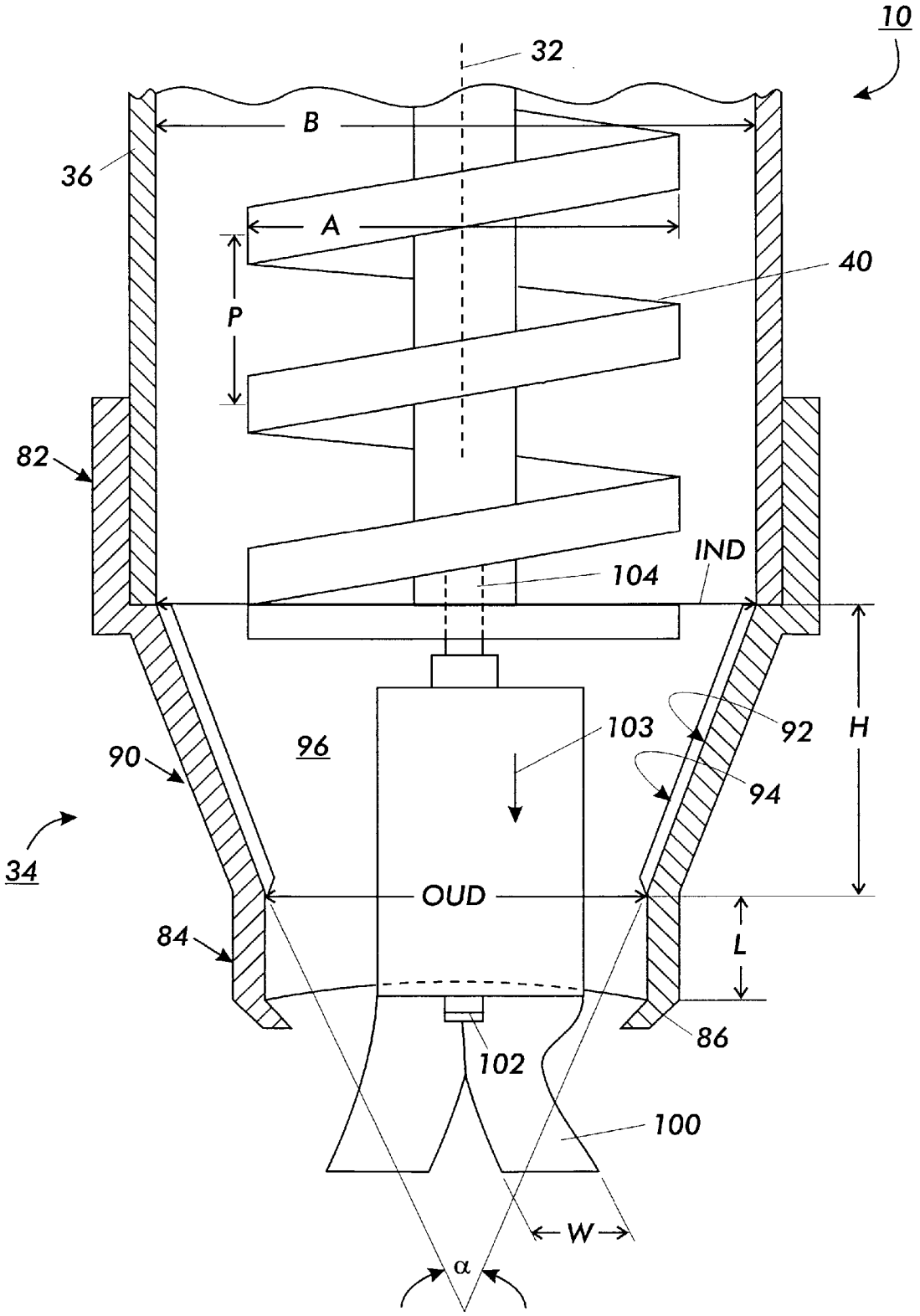
FIG. 1 is a cross-sectional schematic view of a first embodiment of a high speed nozzle for developer material according to the present invention.

Referring now to FIG. 1, the nozzle 34 is shown in greater detail. The nozzle 34 may be made of any suitable durable material, e.g. a plastic or a metal that is chemically non-reactive with the powder 12. For example, the nozzle 34 may be made of stainless steel.

The nozzle may have any suitable shape but includes an inlet 82 adjacent the conduit 36 as well as an outlet 84 opposed to the inlet 82. The nozzle 34 is secured to the conduit 36 in any suitable fashion. For example, as shown in FIG. 1, the nozzle 34 is press fitted over the conduit 36. It should be appreciated that the nozzle may be secured to the conduit by means of fasteners, glue or by welding. Preferably, extending inwardly from the outlet 84 are guide tabs 86 which serve to guide the nozzle 34 into the opening 42 of the container 16. Between the inlet 82 and the outlet 84 of the nozzle 34 is a central portion 90 of the nozzle. The central portion 90 preferably has a hollow substantially conofrustrical shape or funnel like shape.

To assist in the flow of powder 12 within the interior of the nozzle 34, the central portion 90 of the nozzle 34 preferably is coated on inner periphery 92 of the nozzle 34 with a coating 94. The coating 94 is preferably made of a material with a low coefficient of friction. A coefficient of friction of less than 0.25 is preferred. Polytetrafluoroethylene is particularly well suited for this application.

The auger 40 is rotatably secured within the conduit 36. The auger 40 may float within the conduit 36 or be supported to the conduit 36 at its distal ends. The auger 40 may be of any particular configuration but preferably is a spiral auger. The auger 40 rotates at a suitable speed to optimize the flow of powder 12 through the nozzle 34.

For example, for a conduit 36 having a diameter B of 1.25 inches, the auger 40 preferably has an auger diameter A of approximately 1.0 inches. For an auger with an auger diameter A of 1.0 inches, the auger 40 may rotate at a rotational speed of approximately 500 rpm. For the auger with an auger diameter A of 1.0 inches, the auger 40 may have a pitch P or distance between adjacent blades of the auger of approximately 1.0 inches. It should be appreciated that the optimum rotational speed of the auger 40 is dependent on the value of the pitch P.

As shown in FIG. 1, the auger 40 may terminate at the inlet portion 82 of the nozzle. The invention may be practiced with the central portion 90 of the nozzle 34 including an empty cavity or chamber 96.

The nozzle 34 is designed such that the nozzle has an inlet diameter IND at inlet 82 which is larger than outlet diameter OUD such that the flow of powder for a given auger and rotational speed may be maximized. It should be appreciated that different powders have different densities and thus the dimensions of IND and OUD need to be varied for optimum flow of the powder. For example, as shown in FIG. 1, for a toner having a particles size of approximately 7 microns and utilizing an auger 40 with a rotational speed of 500 rpms, the inlet diameter IND is approximately 1.25 inches and the outlet diameter OUD is approximately 0.875 inches. For a nozzle with a distance between the inlet and outlet or height H of the central portion of approximately 0.7 inches, the included angle $\alpha$ of the inner periphery 92 of the nozzle 34 is approximately 20 degrees.

When utilizing the nozzle 34 to fill containers having an opening which is not concentric with the container, the use of a deflector 100 is preferred. Preferably, the deflector 100 is mechanically connected to the auger 40 and rotates therewith. As shown in FIG. 1, the deflector 100 is connected to holder 102. Holder 102 is secured to auger 40 by any suitable means. For example, the holder 102 is secured to auger 40 by means of threads 104.

The deflector 100 may be made of any suitable material. For example, the deflector may be made of plastic or metal. The deflector 100 may be made of stainless steel. As shown in FIG. 2, the deflector 100 is in the form of deflector blades. While the deflector 100 may be made from a single blade, preferably the deflector 100 includes a plurality of equally spaced blades around holder 102. As shown in FIG. 1, the deflector blade has a width W of approximately 0.60 inches for use when the nozzle 34 has an OUD of 0.875 inches.

Preferably, the outlet 84 extends in a direction of arrow 103 along axis 32 a distance L of 0.2 inches to permit the nozzle 34 to engage the opening 42 of container 16 (see FIG. 2).

Figure 4:
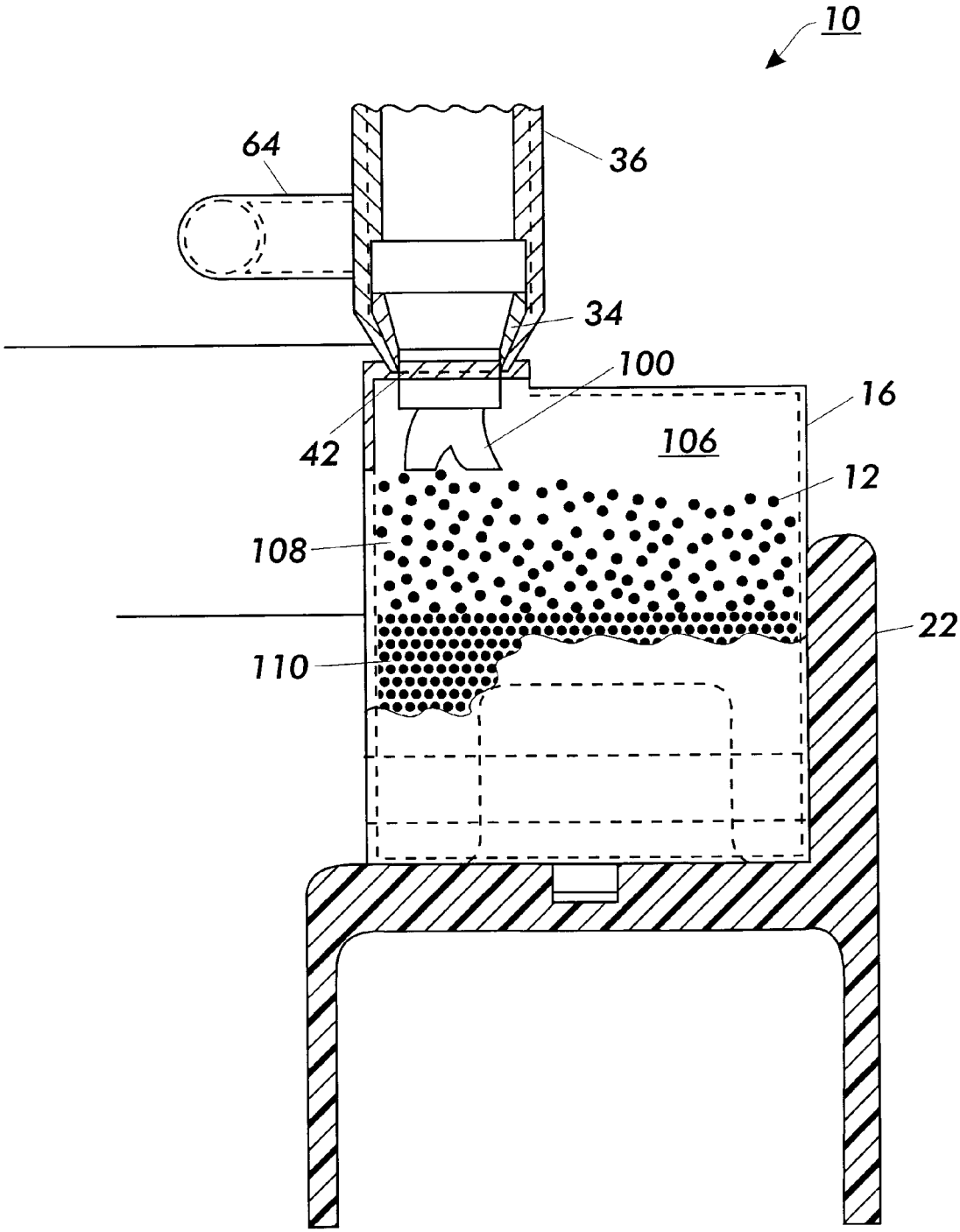
FIG. 4 is a side view of the container filling system of FIG. 2.

Referring now to FIG. 4, the toner filling assisting apparatus 10 is shown engaged with toner container 16. As shown in FIG. 4, the nozzle 34 is immersed into the toner container 16 through opening 42 therein. The deflector 100 is located within chamber 106 of the container 16. The deflector 100 serves to deflect the powder 12 within the container 16 to provide an area of airborne toner 108 in the upper portion of the container. As the airborne toner 108 settles, settled toner 110 forms uniformly within the container 16 assuring a thorough filling of the container 16.

Figure 7:
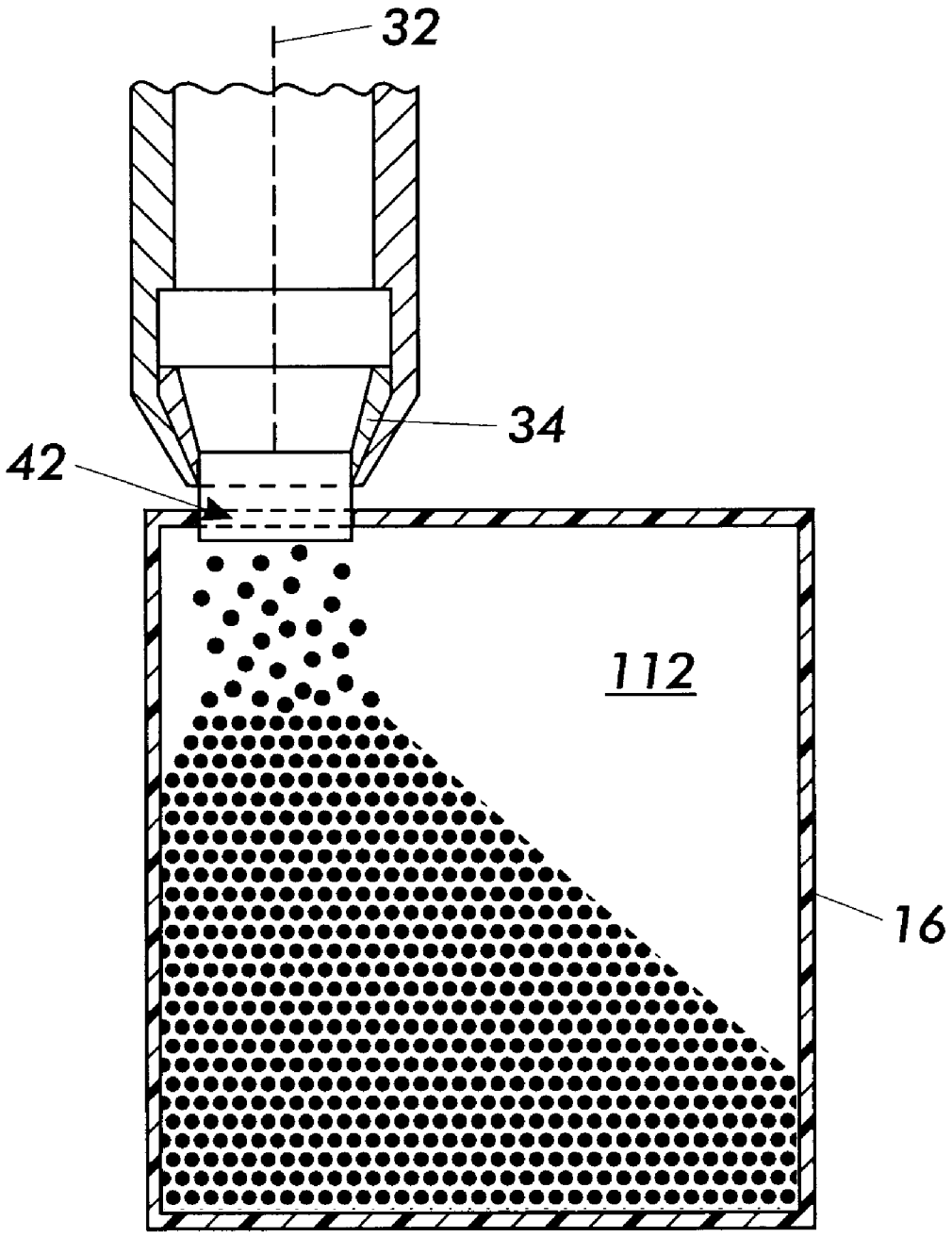
FIG. 7 is an elevational view of a container for use with the high speed nozzle of FIG. 1 without the deflector showing the filling of the container.
Figure 8:
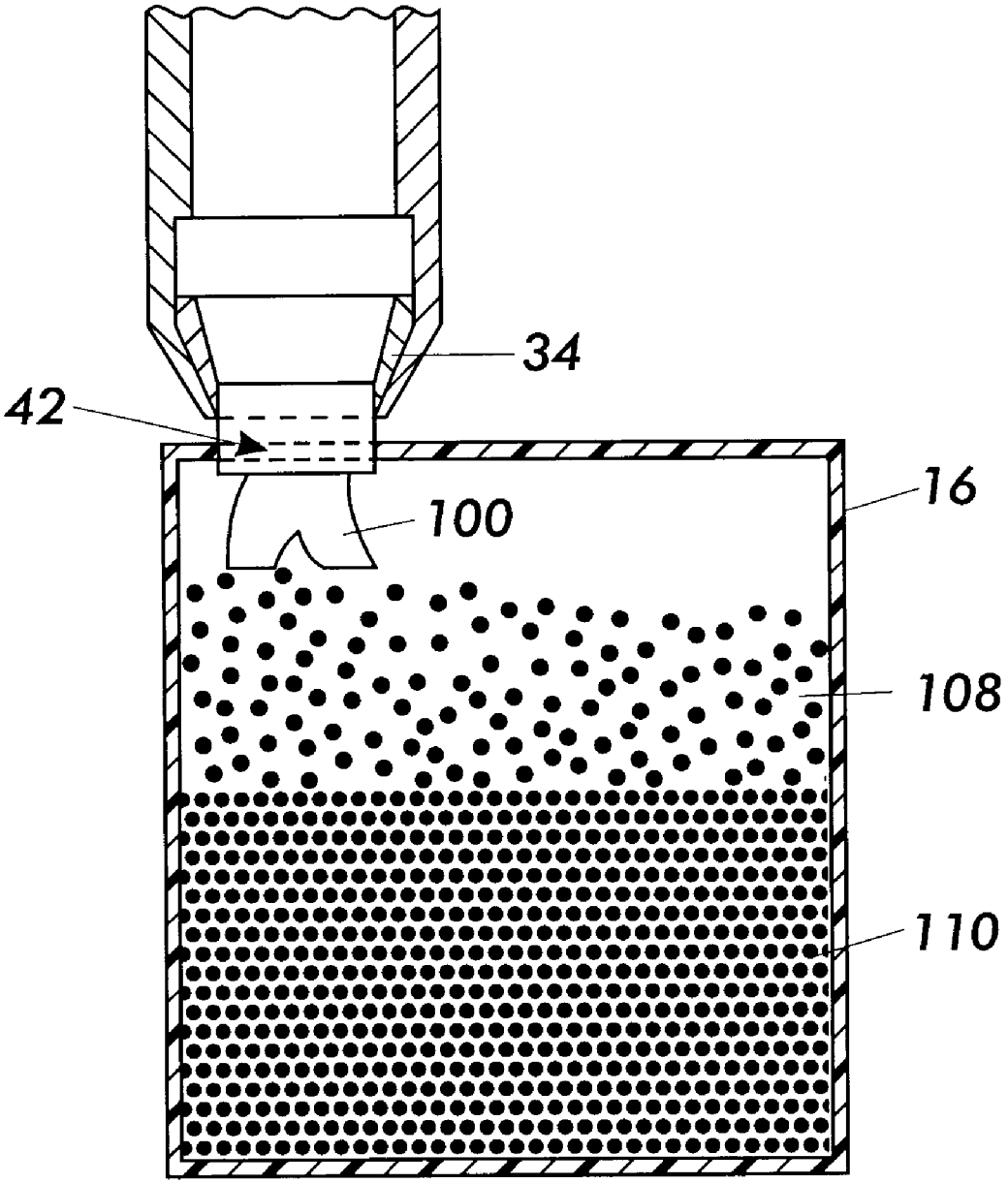
FIG. 8 is an elevational view of a container for use with the high speed nozzle of FIG. 1 showing the deflector in use to disperse the developer material.

Referring now to FIGS. 7 and 8, the advantage of utilizing the deflector 100 is shown. In FIG. 7, the nozzle 34 is shown without the deflector 100 in place. The nozzle 34 directs the powder 12 into a pile centered along nozzle centerline 32. As can be appreciated from FIG. 7, an air gap 112 is formed within the cartridge 16 creating a partially filled toner container 16.

Referring now to FIG. 8, the nozzle 34 is shown with the deflector 100 secured therein. The deflector 100 serves to scatter the toner into airborne toner 108 which settles into settled toner 110 which is evenly dispersed within the toner container 16.

Figure 5:
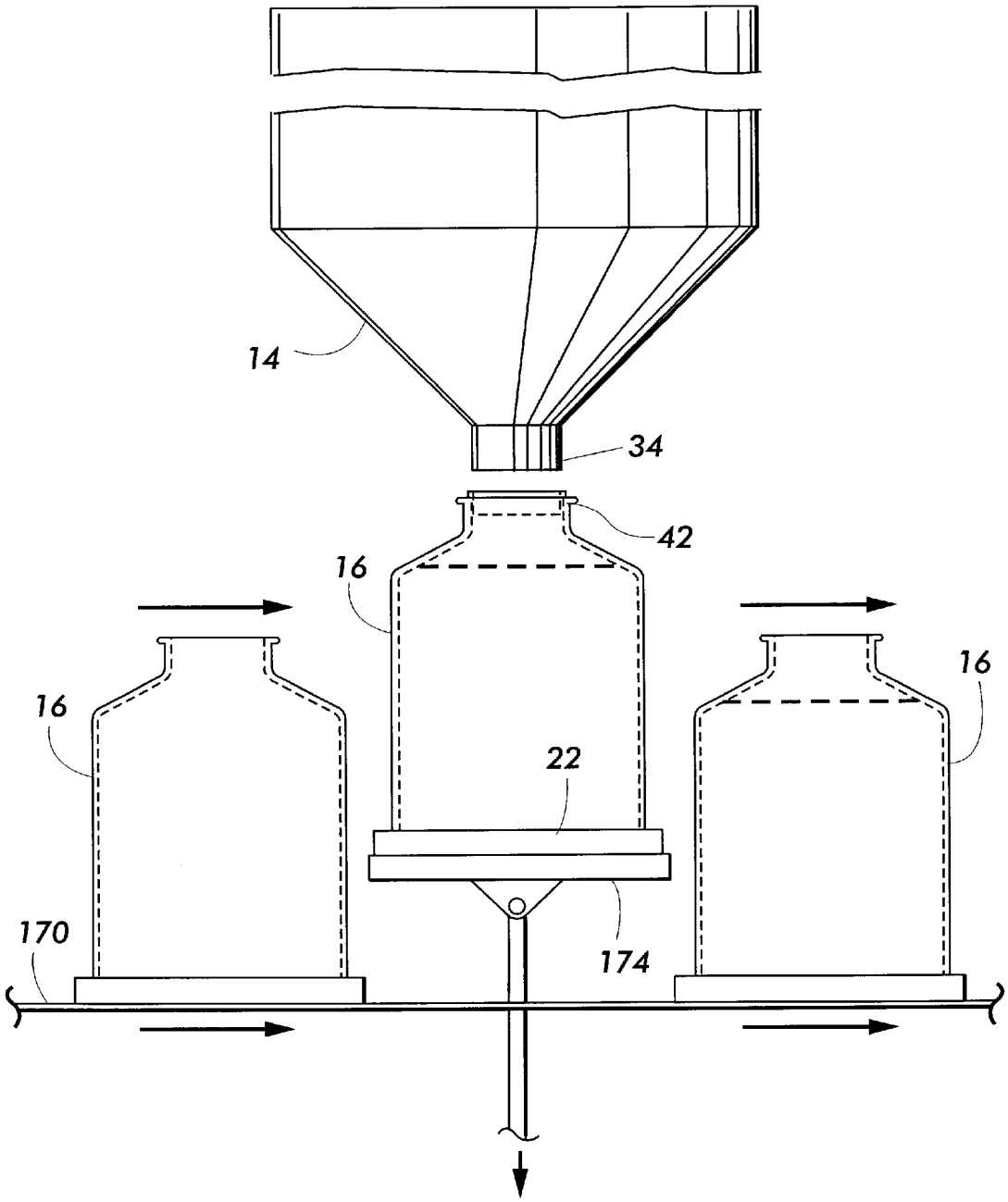
FIG. 5 is an elevational view of a container filling system partially in section for use with the high speed nozzle for developer material of FIG. 1 after the container is filled.

Now referring to FIG. 5, a side view of moving containers 16 along an indexing conveyor 170 relative to the nozzle 34 is depicted, which is relevant to all of the embodiments. Each of the containers is positioned in a carrying device 22, also known as a puck. Each puck is specially designed and built for each type of toner container, the puck allowing for different container widths and heights. A puck is used so that the same conveying and lifting system can be used with varying toner container types. When the container is in position under the fill tube the lifting mechanism 174 pushes the puck with the container in it up until the lifting mechanism is fully extended. When the lifting mechanism is fully extended, the container is in the proper filling relationship with the fill tube. It should be appreciated that the container may be placed on a conveyor without a puck, particularly if the filling line is a dedicated line and if the container has a self-supporting shape that would not to permit the container to easily tip.

Figure 6:
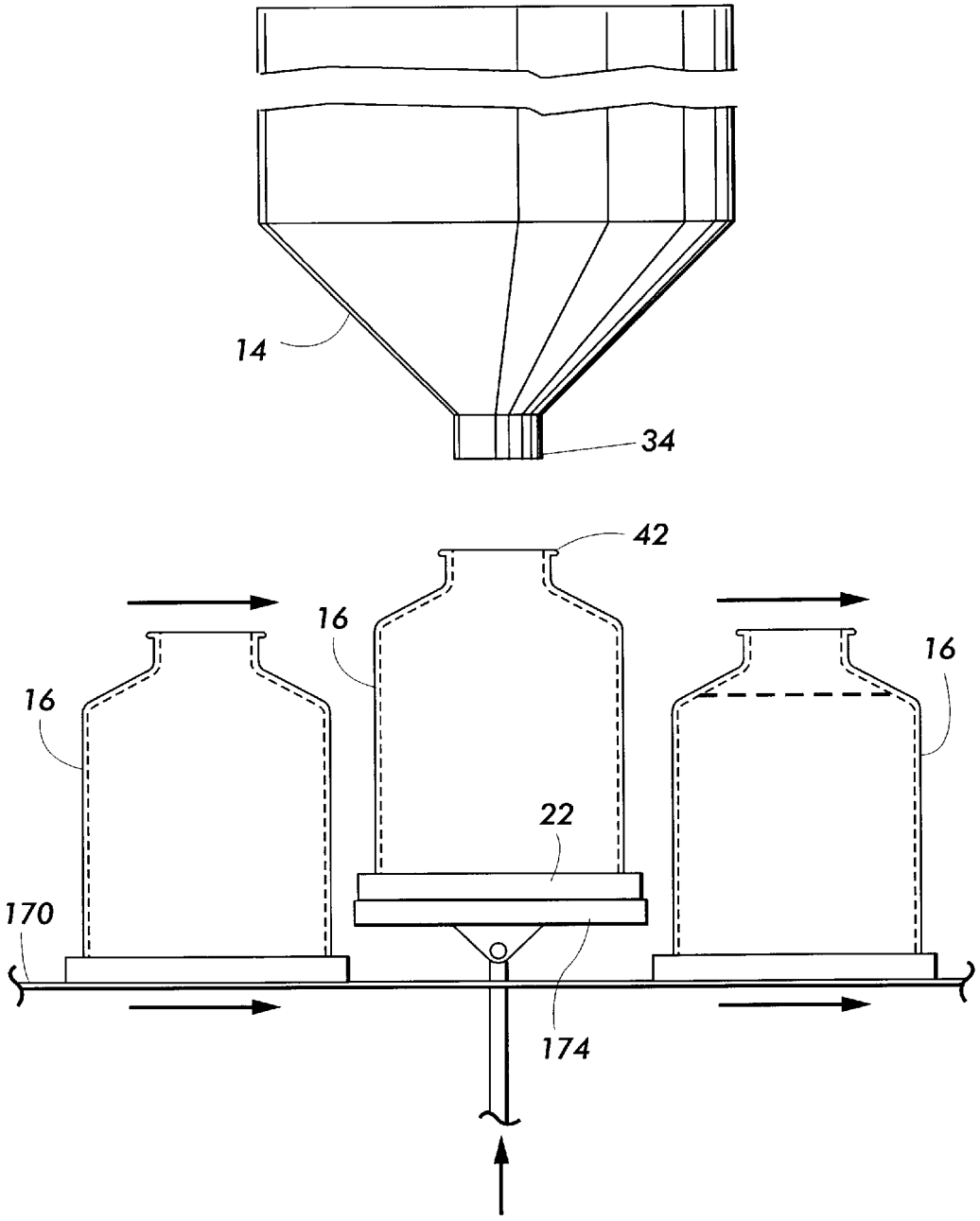
FIG. 6 is an elevational view of the container filling system for use with the high speed nozzle for developer material of FIG. 1 prior to filling the container.

FIG. 6 shows the container in the proper filling relationship to the fill tube, the container opening 42 receiving the end of the nozzle 34. The amount of toner loaded in the container is predetermined based on the size of the container and the toner flow is controlled by a particular number of cycles of the high speed filler. Once the predetermined amount of toner passes through the fill tube for a particular number of cycles of the high speed filler the container is filled and the filling process is stopped so that the container may be moved from under the fill tube.

Figure 9:
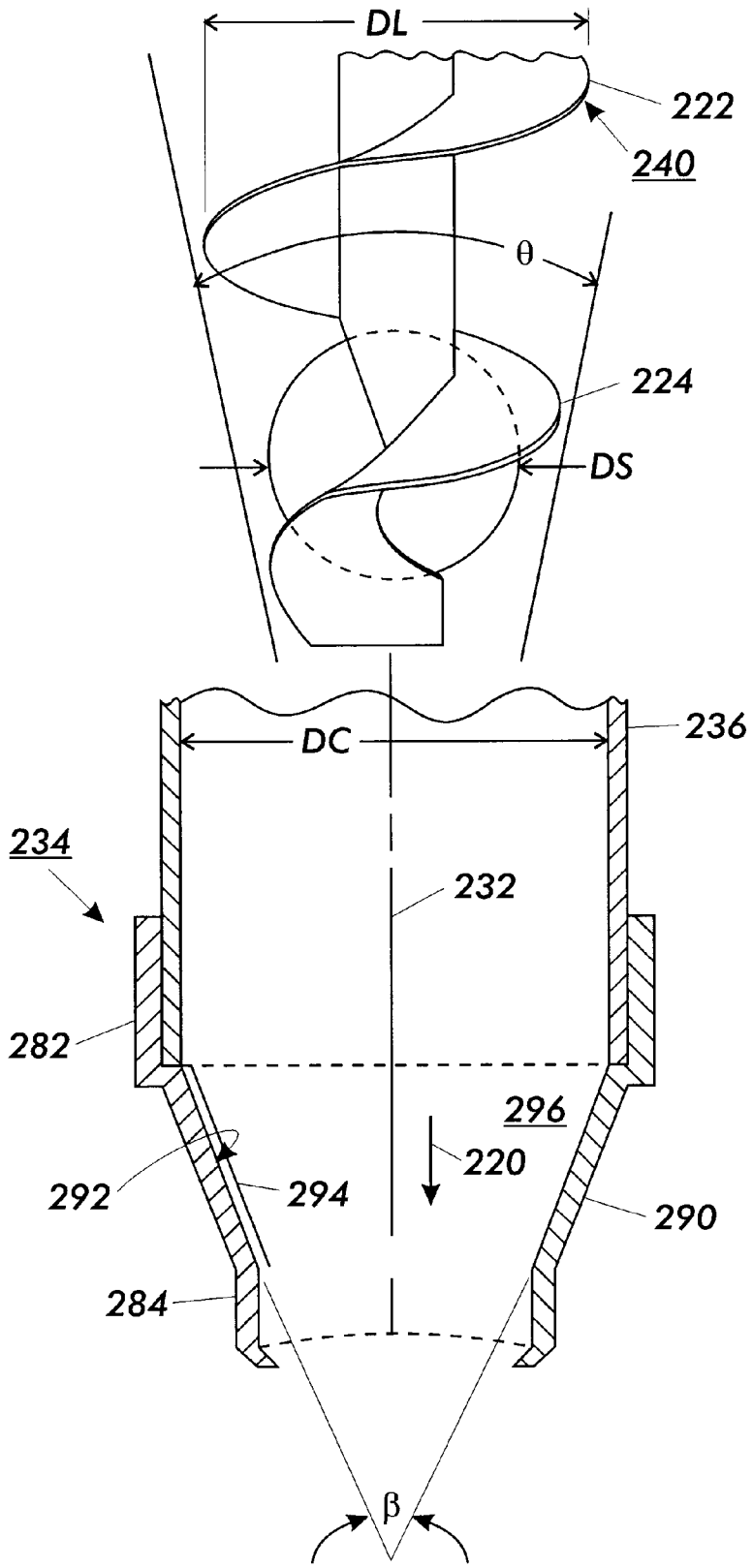
FIG. 9 is a cross-sectional schematic view of an alternate embodiment of the high speed nozzle for developer material of the present invention utilizing a tapered auger with the auger removed from the nozzle.

Referring now to FIG. 9, a first alternate embodiment of the nozzle of the present invention is shown in nozzle 234. Nozzle 234 is similar to nozzle 34 of FIGS. 1–7. Nozzle 234 is secured to conduit 236. Conduit 236 is similar to conduit 36 of FIGS. 1–7. Auger 240 is rotatably fitted within conduit 236 and serves to advance the powder 12 in the direction of arrow 220 along axis 232. Auger 240 includes a cylindrical portion 222 which is matedly fitted to conduit 236. Cylindrical portion 222 has a diameter DL which is slightly smaller than diameter DC of the conduit. Extending downward from the cylindrical portion 220 of the auger 240 is a tapered portion 224 of the auger 240. The tapered portion 224 is fitted at least partially within cavity 296 formed within inner periphery 292 of the central portion 290 of the nozzle 234. The nozzle 234 is secured to the conduit 236 at inlet 282. Extending downwardly from the central portion 290 of the nozzle 234 is outlet 284. Inlet 282 and outlet 284 are similar to inlet and outlets 82 and 84 of the nozzle 34 of FIGS. 1–7.

Figure 10:
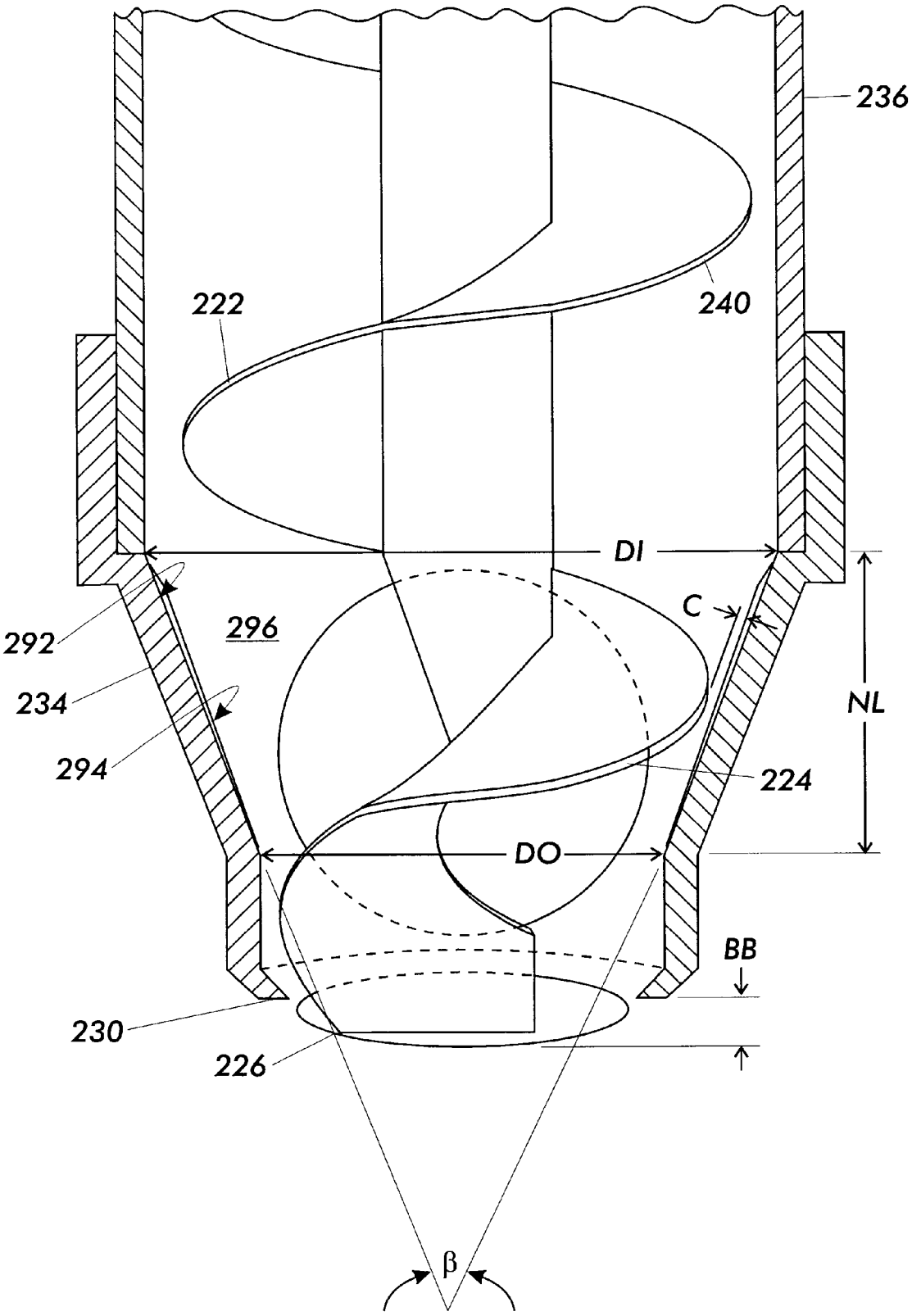
FIG. 10 is a cross-sectional schematic view of an alternate embodiment of the high speed nozzle for developer material of the present invention utilizing a tapered auger with the auger installed in the nozzle.

Referring now to FIG. 10, the auger 240 is shown in position within the nozzle 234. The cylindrical portion 222 of the auger 240 is fitted within the conduit 236 while the tapered portion 224 of the auger 240 is fitted partially within cavity 296. The nozzle 234 similar to the nozzle 34 of FIGS. 1–7, has an inlet diameter DI and an outlet diameter DO. For an auger 240 with a diameter of approximately 1.25 inches preferably the inlet diameter DI is approximately 1.25 inches and the outlet diameter DO is approximately 0.875 inches. The inlet and outlet diameter are spaced apart in the direction of centerline 232 a distance NL of approximately 0.7 inches. Inner periphery 292 of the central portion 290 thus forms an included angle $\beta$ of approximately 20 degrees. Preferably, the tapered portion 224 of the auger 240 has an included angle $\theta$ equal to angle $\beta$ of the inner periphery 292 of the central portion 290 of the nozzle 234. Preferably, the inner periphery 292 of the nozzle 234 includes a coating 294 thereon which is similar to coating 94 of the nozzle 34. The tapered portion 224 of the auger 240 is preferably spaced from the coating 294 a distance C sufficient to provide for operating clearance therebetween. A dimension C of approximately 0.05 inches is sufficient.

Optionally, the auger 240 may include a protruding portion 226 which extends downwardly from the tapered portion 224 of the auger 240. The protruding portion 240 extends a distance BB below lower surface 230 of the nozzle 234. A distance BB of approximately 0.2 inches has been found to be sufficient. The protruding portion 226 serves to prevent clogging of the powder within the nozzle 234 as well as to provide a method of deflecting the toner particles to evenly fill the container.

Figure 11:
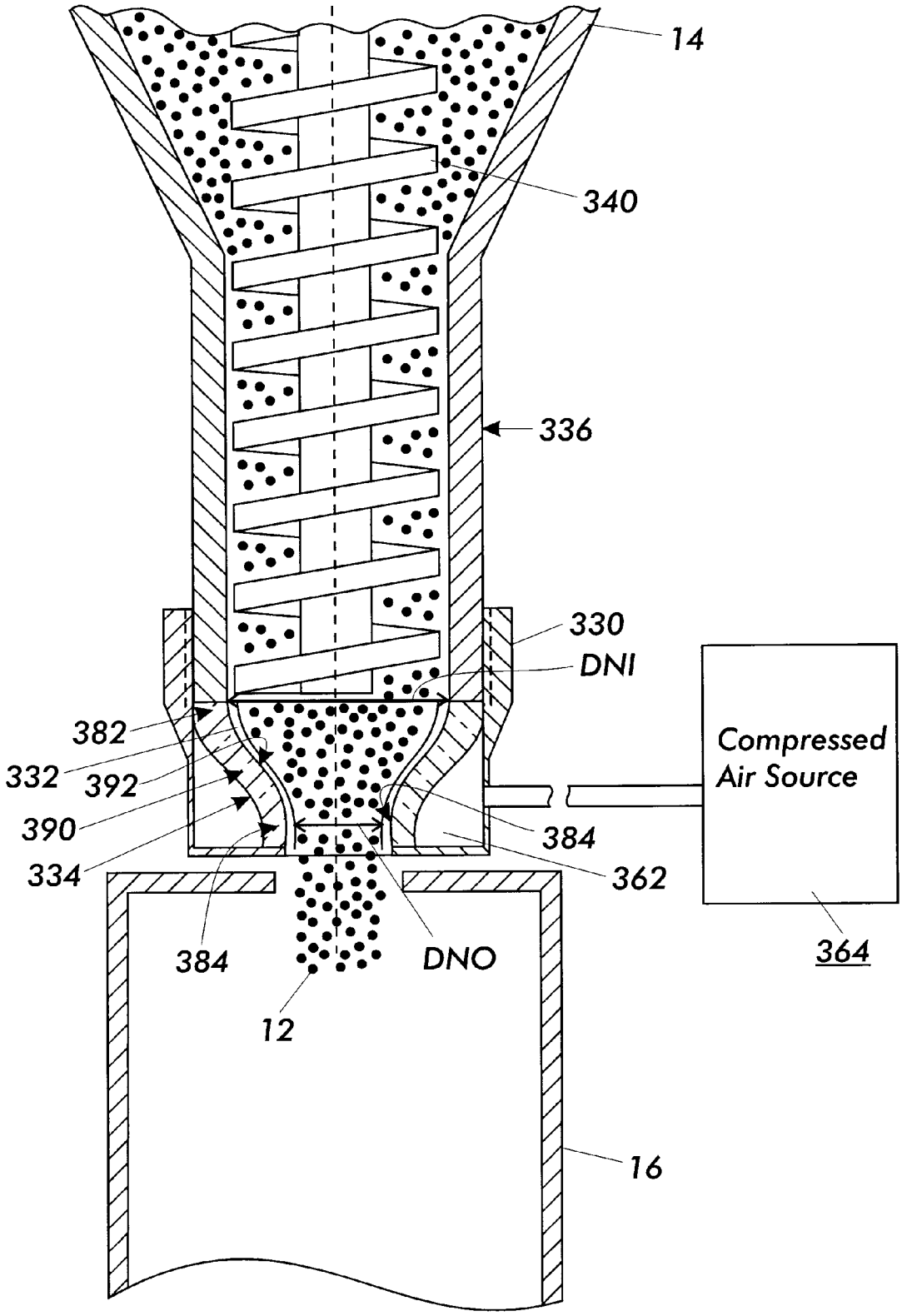
FIG. 11 is a cross-sectional schematic view of a second alternate embodiment of the high speed nozzle for developer material of the present invention utilizing a nozzle with an air boundary for reduced friction.

Referring now to FIG. 11, a second alternative embodiment of the nozzle according to the present invention is shown as nozzle 334. Nozzle 334 is secured to conduit 336 and extends downwardly therefrom. Conduit 336 is similar to conduit 36 of FIGS. 1–7. Auger 340 is preferably rotatably fitted within conduit 336. Auger 340 is similar to auger 40 of FIGS. 1–7. As shown in FIG. 11, the nozzle 334 extends downwardly from the conduit 336. The nozzle 334 includes a tapered portion 390 which has a generally conofrustrical hollow shape. The tapered portion 390 as shown in FIG. 11 has a concave or bowl type shape. It should be appreciated that the tapered portion 390 may likewise have convex or a neutral shape. The tapered portion 390 has a diameter DNI at nozzle inlet 382 and a diameter DNO at the nozzle outlet 384 which is smaller than the nozzle inlet diameter DNI. The nozzle 334 as shown in FIG. 11 is made of a porous material. The nozzle 334 may be made of any suitable durable material e.g. a porous plastic material. Such a porous plastic material is available from Porex Technologies Corporation, Fairburn, Ga., USA and is sold as Porex® porous plastics. The use of high density polyethylene with a pore size of approximately 20 microns is suited for this application.

To assist in the flow of the toner 12 and to avoid coating the inner periphery 392 of the nozzle 334 with a coating which may tend to wear quickly, the nozzle 334 includes a boundary layer of flowing air 332 located internally of inner periphery 392 of the nozzle 334. The boundary layer of flowing air 334 may be accomplished in any suitable manner. For example, as shown in FIG. 11, the nozzle 334 is surrounded by a housing 330. The housing 330 is secured to the conduit 336 and to the bottom portion of the nozzle 334. The housing 330 thus forms an external cavity 362 between the housing 330 and nozzle 334. Preferably, the external cavity 362 is connected to a compressed air source 364 whereby compressed air is forced through the porous nozzle 334. The compressed air source 364 thus serves to provide the boundary layer of flowing air 332 between the nozzle 334 and the powder 12. The compressed air source may include a valve (not shown) to regulate the amount of air in order to form a proper boundary layer of flowing air 332 to optimize the flow of toner 12 through the nozzle 334.

Figure 12:
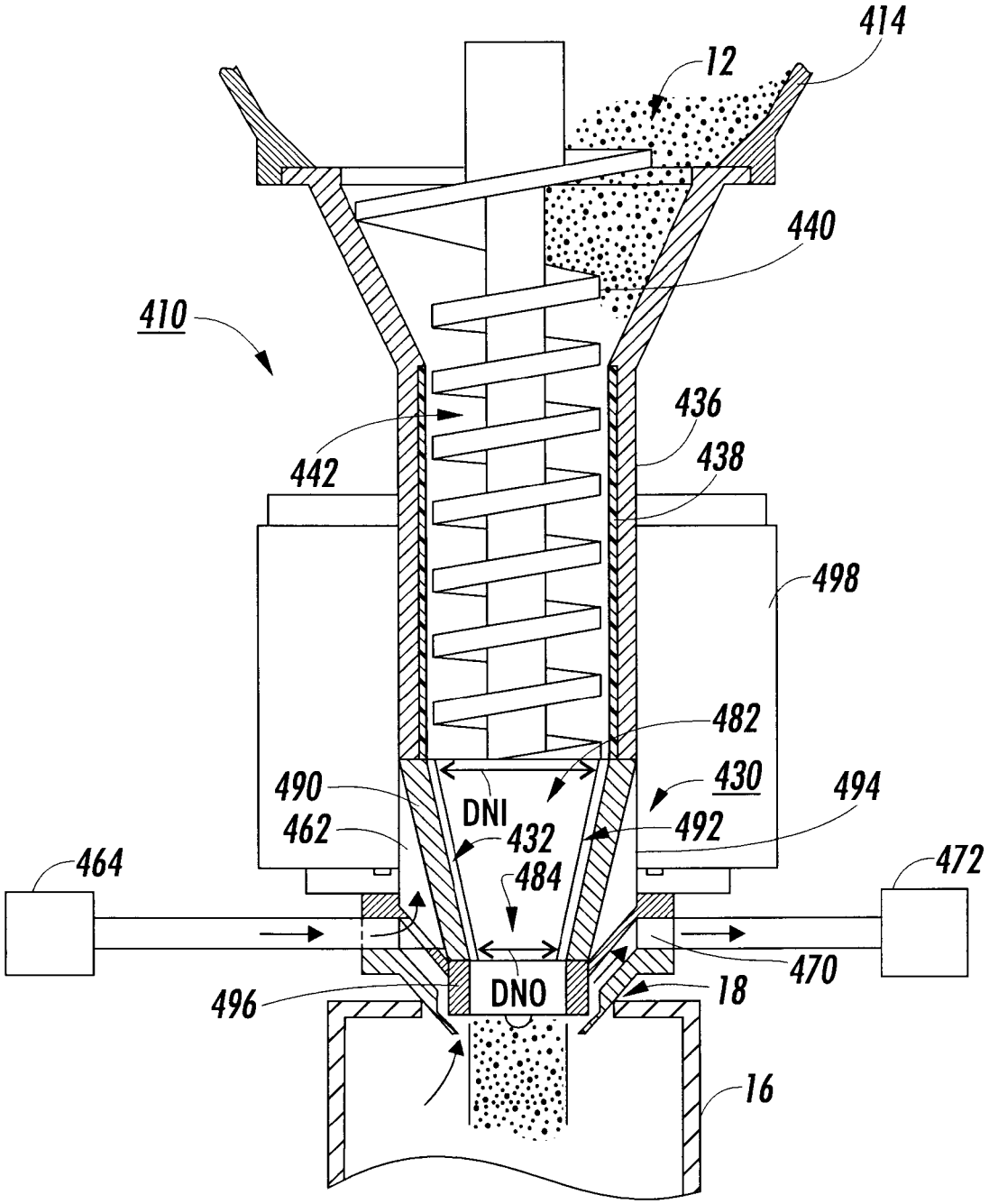
FIG. 12 is a cross-sectional schematic view, similar to the embodiment of the invention shown in FIG. 11, with an electromagnetic valve for stopping the flow of magnetic particulates.

FIG. 12 is an embodiment of the invention similar to that shown in FIG. 11. Nozzle assembly 430 is secured to conduit 436 and extends downwardly therefrom. Conduit 436 is similar to conduit 336 and auger 440 is similar to auger 340. Housing 56 of FIGS. 2 and 3 is not necessary in this embodiment.

At least a portion of the inner surface of conduit 436 is coated or lined with liner 438 that is made of a material with a low coefficient of friction and low surface tension on the surface that contacts the particulate material. For example, the surface of liner 438 that contacts the particulate material can have a coefficient of friction that ranges from about 0.10 to about 0.25. Examples of preferred liner material are polytetrafluoroethylene, nylon, and the like low non-stick materials. In a preferred embodiment a low friction sleeve, liner, or coating resides on at least a portion of the inner surface of conduit 436 and adjacent to nozzle assembly 430, preferably the length of the cylindrical portion of conduit 436, as shown. When electrostatic particulate material is used, as in the case of toner, having the liner also made of low triboelectric charging material is desirable to prevent the electrostatic particles from sticking to conduit 436. Liner 438 obviates the need for additional agitation equipment, which was required to restore flow in some prior art devices. Liner 438 also reduces the heat generation due to frictional forces when the particulate material is moved by auger 440.

As shown in FIG. 12, nozzle assembly 430 extends downwardly from conduit 436. Nozzle assembly 430 is similar to nozzle 334, however tapered portion or porous nozzle 490 has straight frustroconical sides, rather than the concave shape of nozzle 334. Tapered portion 490 has a diameter DNI at nozzle inlet 482 and a diameter DNO at nozzle outlet 484, which is smaller than the nozzle inlet diameter DNI. In a preferred embodiment, DNI at nozzle inlet 482 is at least twice the diameter as DNO at nozzle outlet DNO. Porous nozzle 490 as shown in FIG. 12 is made of a porous material similar to that of tapered portion 390.

The dimensions of nozzle assembly 430 are selected so as to provide a ratio of the inlet cross sectional area to the outlet cross sectional area such that the flow of the particulate material does not seize as it progresses through the apparatus in conjunction with the operation of the auger, liner and nozzle assembly, while maximizing the rate of particulate material transport. Porous nozzle 490 is sized and shaped with respect to fill tube 436 and auger 440 so that particulate 12 flow through fill tube 436 and porous nozzle 490 remains substantially constant while auger 440 is operating. Auger 440 takes up a certain volume $V_{440}$ within fill tube 436, allowing for particulate 12 to travel through fill tube particulate regions 442 having a volume $V_{442}$, the regions within fill tube 436 where auger 440 is absent. The volume of particulate 12 within fill tube 436 is determined by subtracting the volume $V_{440}$ of auger 440 from the volume $V_{436}$ of fill tube 436.

During the filling process the rate at which particulate 12 is delivered to porous nozzle 490 can be calculated by taking into consideration the type of auger used, speed of the auger, bulk density of the particulate material, volume of the auger, and volume $V_{436}$ of fill tube 436. The bulk density is defined as the mass of powdered or granulated solid material per unit of volume.

Particulate material delivered per auger revolution:

$$BD_{part}\times(V_{436}-V_{440})=(BD_{part}\times V_{442})/\text{revolution}$$

Particulate material delivered per minute:

$$(BD_{part}\times V_{442})/\text{revolution}\times(\text{revolutions/minute})=(BD_{part}\times V_{442})/\text{minute}$$

where $BD_{part}$=Particulate material bulk density

Inlet diameter, DNI, of nozzle assembly 430 is the same as the outlet diameter of fill tube 436. Outlet diameter, DNO, of nozzle assembly 430 is determined by the amount of compression necessary to increase the bulk density of particulate 12 and is no larger than the diameter of container opening 18. Porous nozzle 490 is sized and shaped so that the rate at which particulate 12 enters nozzle inlet 482, is substantially the same rate at which particulate 12 exits nozzle outlet 484. The lower end of the nozzle assembly 430 preferably includes nozzle end 496 (described below). It is desirable to maximize the bulk density of particulate material 12 as it exits nozzle assembly 430 in order to maximize the mass per unit time of particulate material 12 delivered to container 16. Maximum bulk density of particulate material 12 is limited to maintaining particulate material flow.

Porous nozzle 490 includes a boundary layer of flowing air 432 located internally of inner periphery 492. The purpose of air boundary layer 432 is to provide a substantially frictionless surface so that particulate material 12 does not stick to the inner surface of porous nozzle 490. The boundary layer of flowing air 432 may be accomplished in any suitable manner, however it is important that the bulk density of particulate material 12 flowing past air boundary layer 432 is not affected by air boundary layer 432. This insures that the maximum bulk density of particulate material is delivered to container 16.

For example, as shown in FIG. 12, porous nozzle 490 is surrounded by nozzle housing 494. Nozzle housing 494 is secured to conduit 436 and to the bottom portion of the nozzle assembly 430. Housing 494 forms nozzle plenum 462 between housing 494 and porous nozzle 490. Preferably, nozzle plenum 462 is connected to compressed air source 464 via nozzle inlet 466 whereby compressed air is forced through porous nozzle 490. Compressed air source 464 thus serves to provide the boundary layer of flowing air 432 between porous nozzle 490 and particulate material 12. Compressed air source 464 may include a valve (not shown) to regulate the amount of air in order to form a proper boundary layer of flowing air 432 to optimize the flow of toner 12 through nozzle assembly 430. For example, when particulate material 12 is toner, preferably the boundary layer air flow used is generally between about 500 to about 3,000 ml/minute and is applied continuously. Particulate material 12 flow and airflow are adjusted to insure that air boundary 432 does not permeate or aerate particulate material 12. Preferably, compressed air source 464 is continuously operated to provide air boundary layer 432. During the filling operation when conveyor 440 is operative having a continuous supply of compressed air ensures the desired particulate flow through nozzle assembly 430 and when conveyor 440 is inoperative, it ensures that particulate material 12 does not compact in nozzle assembly 430 because particulate material 12 does not stick to porous nozzle periphery 492.

The bulk density of particulate material 12 is substantially the same in hopper 14 as at nozzle end 496. For example, during the filling operation using a 7 micron magnetic toner, the bulk density of the toner in the hopper was measured to be 0.80 grams/cubic centimeter and the bulk density of the toner at nozzle end 496 as the toner exited nozzle assembly 430 was measured to be 0.78 grams/cubic centimeter. Preferably particulate material 12 is in a solid-like state as opposed to a liquid-like state as it leaves nozzle end 496. Exiting particulate material 12 is paste-like and is in a semi-solid form in that particulate material 12 holds its shape and does not flow when placed on a surface.

The lower end of the nozzle assembly 430 preferably includes nozzle end 496 and vacuum port 470 for engaging vacuum source 472 so that container 16 can be continuously evacuated while nozzle assembly 430 is engaged with the container. The vacuum from vacuum source 472 promotes fill rates by eliminating positive pressure accumulation in the container during the filling process. It is also intended to remove the boundary layer air 432 that exits nozzle end 496 with particulate material 12 so that the boundary layer air does not enter container 16. Vacuum port 470 communicates negative vacuum pressure from vacuum source 472 to container 16. Vacuum source 472 accelerates the container fill rate while removing any residual or stray airborne particulates thereby eliminating particulate contamination and eliminating the need for an additional cleaning step. The vacuum pressure from vacuum source 472 can be, for example, from about 0.1 to about 10 inches of water. While the apparatus can be operated satisfactorily without a vacuum assist, in preferred embodiments, a vacuum is used with a negative pressure of preferably from about 3 to about 5 inches of water. The negative pressure from vacuum source 472 is adjusted so that the vacuum does not interfere with the flow of particulate material, thereby maintaining the bulk density of particulate material 12 as it is delivered to container 16.

Nozzle end 496 is attached at the lower end of porous nozzle 490. Nozzle end 496 is cylindrical and non-porous. Nozzle end 496 is preferably cylindrical in shape, which assists in directing particulate flow downward to container 16. Since nozzle end 496 is not porous, vacuum source 472 does not interact with particulate material 12 until it has exited nozzle end 496. Vacuum source 472 is isolated from and does not communicate with nozzle plenum 462.

In an embodiment where particulate material 12 includes magnetic particles, such as a toner including a resin and a colorant or a developer including a mixture of magnetic or non-magnetic toner and magnetic carrier particles, an electromagnetic valve may be used to stop the flow of particulate material 12. Surmounting nozzle assembly 430 and circumscribing conduit 436 is electromagnetic valve assembly 498, which is described in U.S. Pat. No. 5,839,485. When energized, electromagnetic valve 498 holds magnetic particulate 12 in place by applying a magnetic force sufficient enough to overcome the force of gravity applied to the particles. Electromagnetic valve 498 is energized prior to filling a container and after a container is filled so that magnetic particulate material 12 does not fall and contaminate the outside of container 16 as the container is removed from nozzle assembly 430. During the filling operation, electromagnetic valve is de-energized, enabling magnetic particulate 412 to travel through conduit 436 and nozzle assembly 430 to container 16. Electromagnetic valve 498 provides for rapid starting and stopping of the flow of particulate material through filling apparatus 410.

Figure 13:
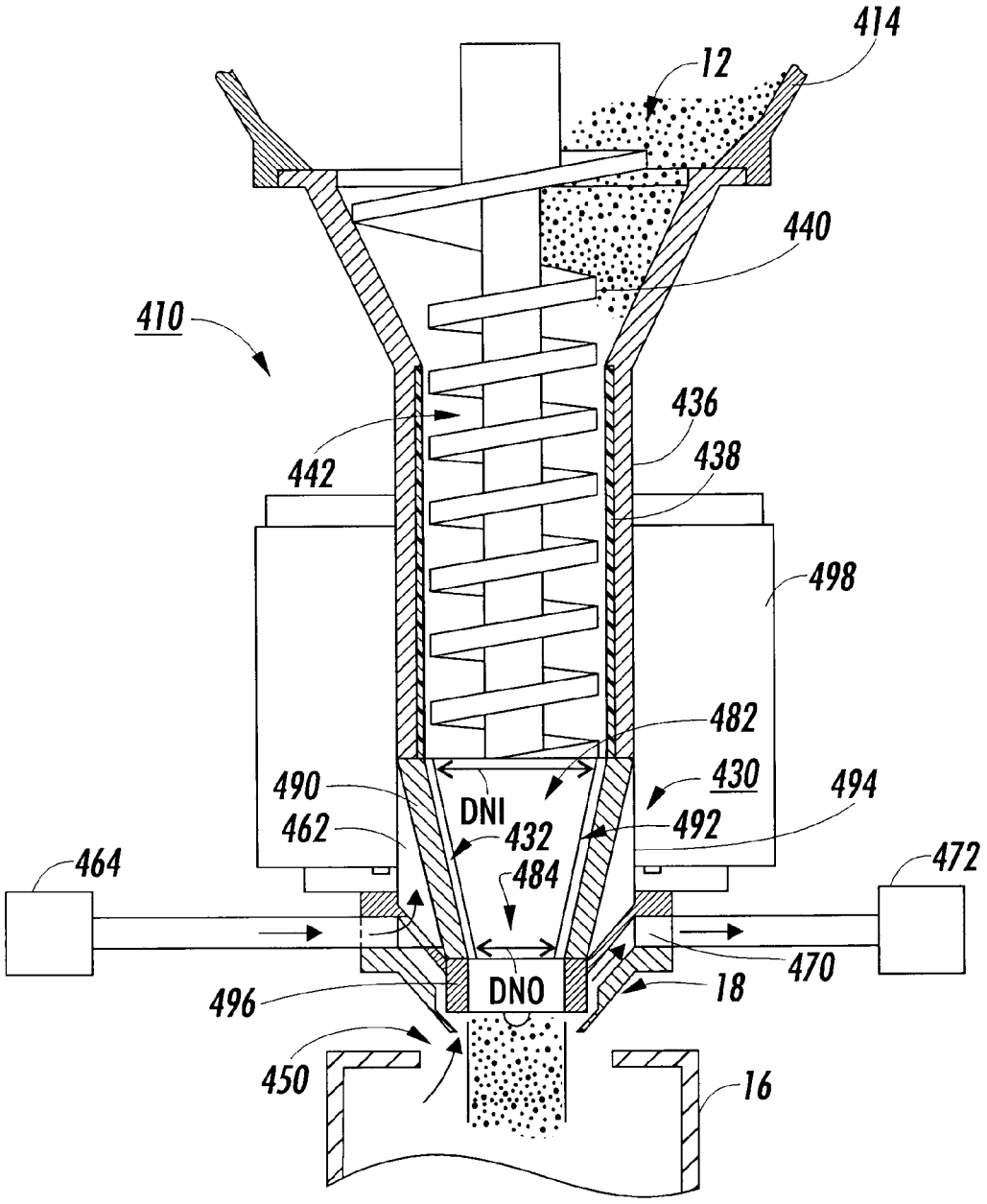
FIG. 13 is a cross-sectional schematic view, similar to the embodiment of the invention shown in FIG. 12, with a gap formed between the nozzle and container during filling.

FIG. 13 shows an embodiment of the invention similar to FIG. 12, however in this embodiment, there is a nozzle/container gap 450 between nozzle assembly 430 and container opening 18. Rather than moving the container into and out of a filling relationship from a conveyor belt as shown in FIGS. 5 and 6, container 16 can remain on conveyor 170 during the filling operation. Gap 450 may exist between nozzle assembly and container opening 18 due to the denseness of particulate material 12 as it leaves nozzle assembly 430. When particulate material 12 is toner, particulate material 12 has a paste-like consistency as it leaves nozzle assembly 430, which means that particulate material 12 will continue traveling in the downward direction to container 16, rather than scattering at gap 450. Allowing container 16 to remain on conveyor 170 simplifies the filling process, which results in a much faster filling operation.

In this embodiment vacuum source 472 is optional, however its use is preferred so that particulate material 12 does not contaminate the outside of container 16 or the area surrounding apparatus 410. Electromagnetic valve 498 is also optional, however in the case of magnetic particulate material, it allows for faster filling due to the additional control of the flow of particulate material 12 from apparatus 410.

Figure 14:
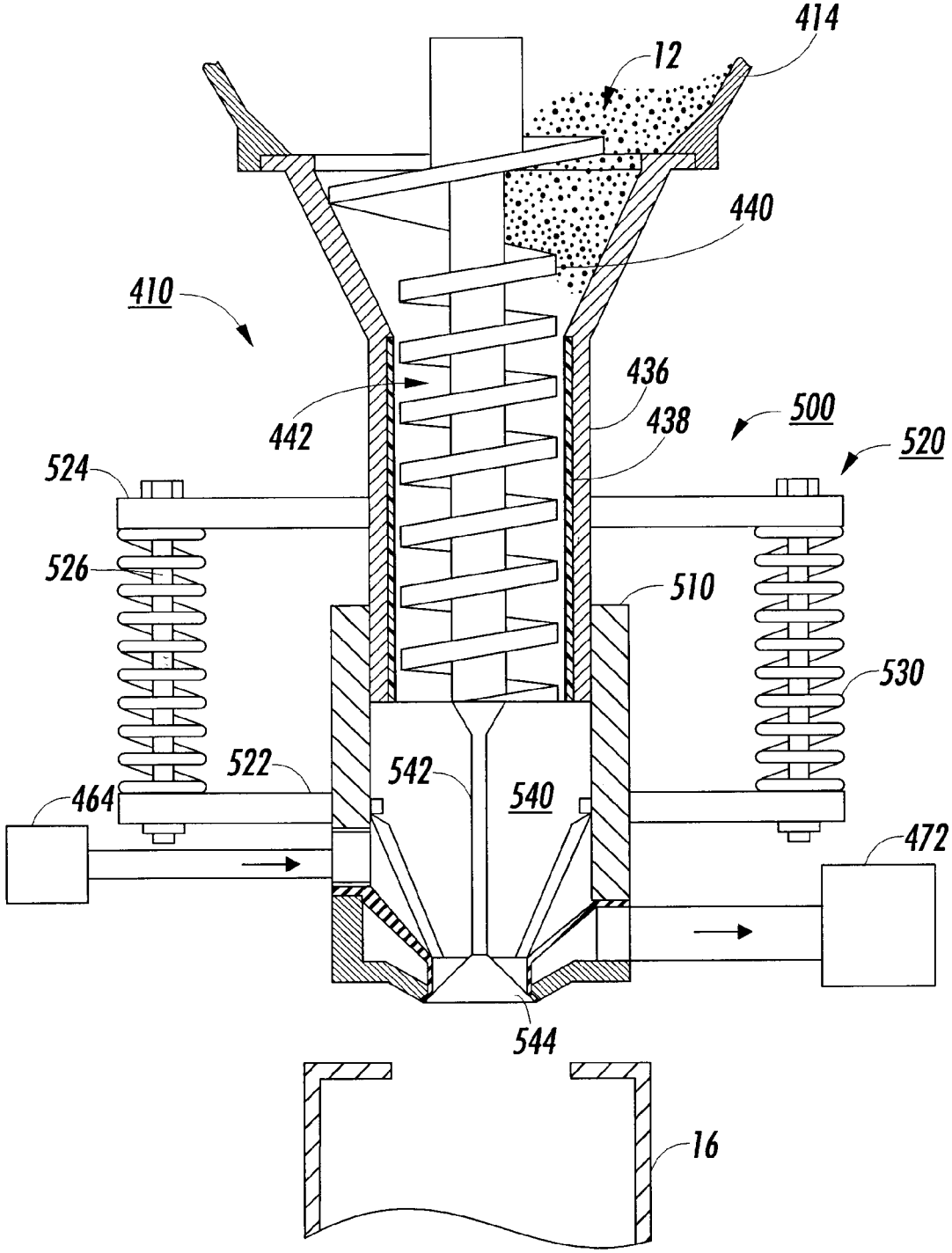
FIG. 14 is a cross-sectional schematic view, similar to the embodiment of the invention shown in FIG. 12, with a mechanical valve having a flow control device attached to the particulate conveyor, in the closed position.
Figure 15:
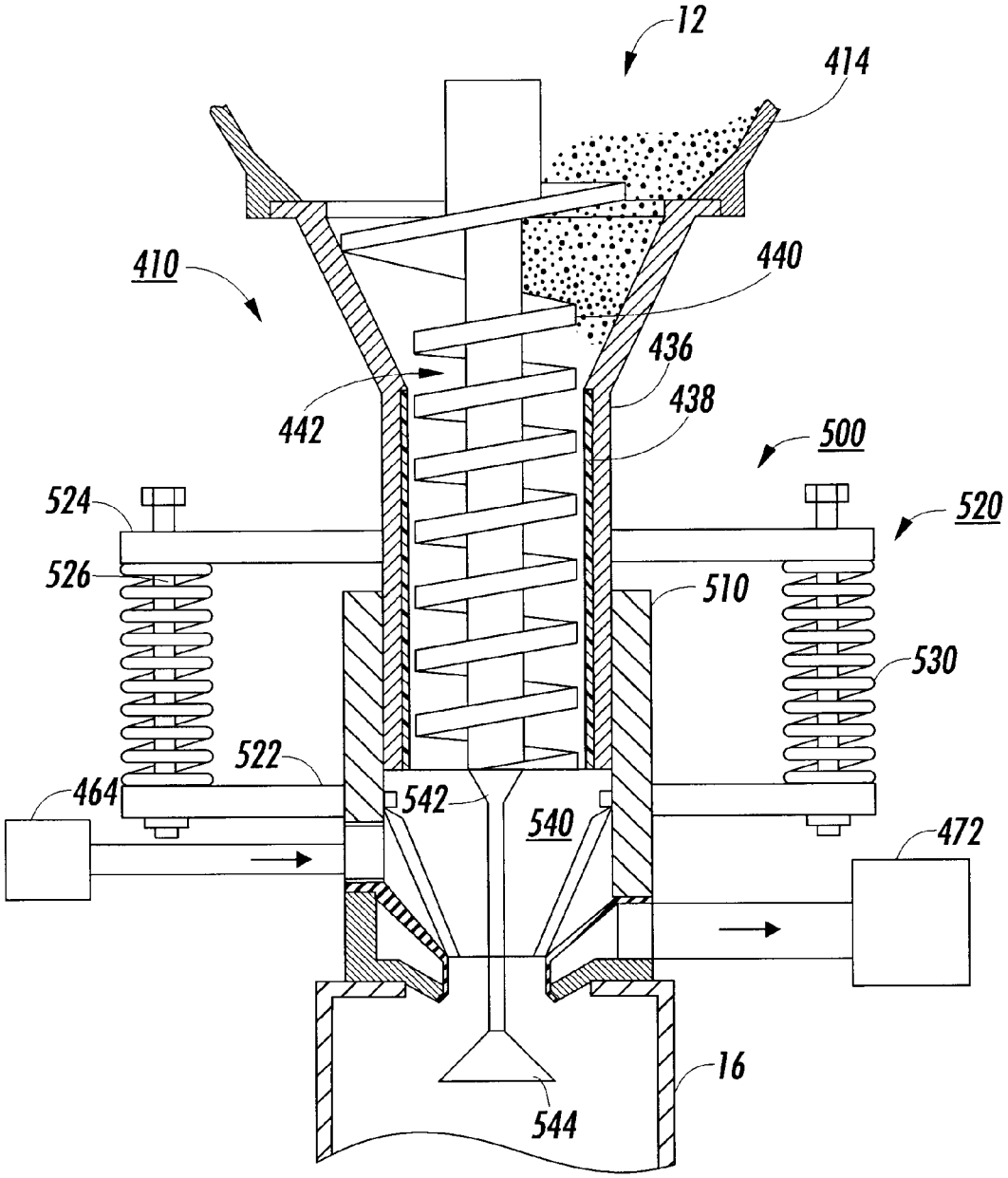
FIG. 15 is a cross-sectional schematic view of the embodiment of the invention shown in FIG. 14, with the mechanical valve in the open position.

The invention shown in FIGS. 14 and 15 is similar to that shown in FIGS. 12 and 13, however in place of electromagnetic valve 498, mechanical valve 500 is used to stop the flow of particulate material between particulate supplying operations. Mechanical valve 500 provides a positive shutoff for particulate flow when using the low friction compression nozzle with both magnetic and non-magnetic particulate material. Also, locating the flow control device below the compression nozzle eliminates particulate material discharge at the end of the supplying cycle.

In FIG. 14 mechanical valve 500 is shown in the closed position. Mechanical valve 500 includes sliding nozzle housing 510 which surrounds funnel tube 436 and operably slides up and down with respect to tube 436. Sliding nozzle housing 510 is supported by nozzle housing support 520. Nozzle housing support 520 has moveable supports 522 attached to sliding housing 510, fixed supports 524 fixed with respect to tube 436, and connecting supports 526 which connect moveable supports 522 and fixed supports 524. In the embodiment shown, springs 530 surround connecting supports 526 and are used to bias moveable support 522 away from fixed support 524 in the closed valve position, however, any well-known biasing support equivalent may be substituted for connecting supports 526 and springs 530.

Particulate flow control device 540 is attached at the lower end of particulate conveyor 440. Particulate flow control device includes flow control support 542 and flow control member 544. In the closed position, as shown in FIG. 14, particulate conveyor 440 is stationary and springs 530 provide sufficient force to move sliding nozzle housing 510 against flow control member 544 to contain and seal particulate material within the sliding nozzle housing.

FIG. 15 shows mechanical valve 500 in the open position. In this position sliding nozzle housing 510 has been moved upwardly towards fixed supports 524. This upward movement creates an opening/clearance between the flow control element 544 and sliding nozzle housing 510 and allows particulate material to flow from tube 436. In the embodiment shown, as container 16 moves into filling position, the top of the container pushes against sliding nozzle 510 providing sufficient force to move moveable supports 522 upwardly to open mechanical valve 500. In the absence of a container supplying the upward force to open the valve, many other force equivalent force mechanisms may be used move moveable supports 522 upwardly.

With mechanical valve 500 in the open position, the particulate supplying operation is begun. Conveyor 440 is rotated to supply particulate material from the hopper to container 16 and since flow control device 540 is attached to the conveyor, the flow control device also rotates. The centrifugal force of rotating flow control member 544 will evenly distribute the toner inside container 16. Preferably flow control member 544 is conically shaped to aid in the dispersement of particulate material in the open position and for positive shutoff in the closed position, however flow control member may be any shape which stops the flow of particulate material from tube 436. Mechanical valve 500 may also be used in the absence of the air nozzle assembly to stop the flow of particulate material.

Figure 16:
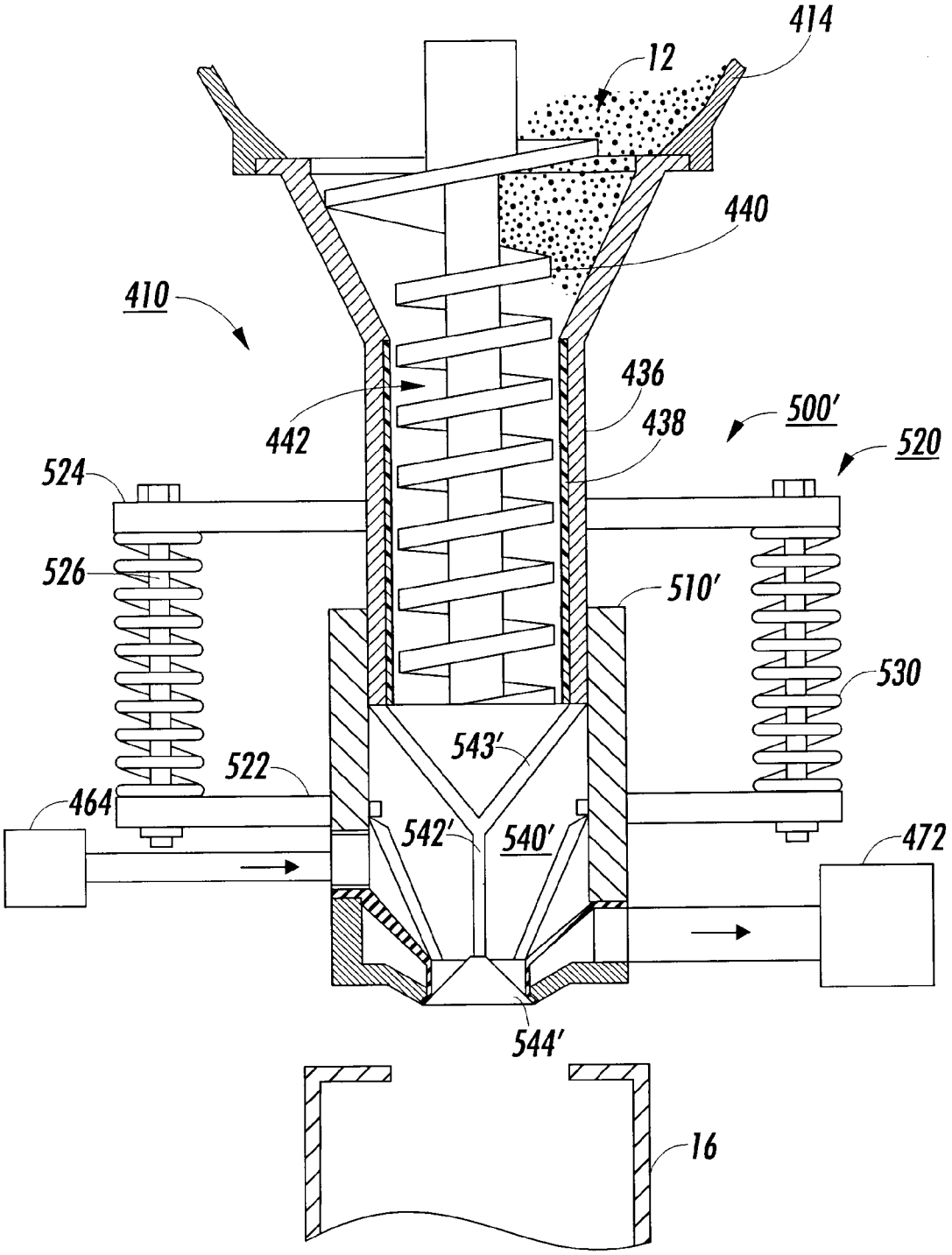
FIG. 16 is a cross-sectional schematic view, similar to the embodiment of the invention shown in FIG. 14, with a mechanical valve having a flow control device fixed with respect to the tube, in the closed position.
Figure 17:
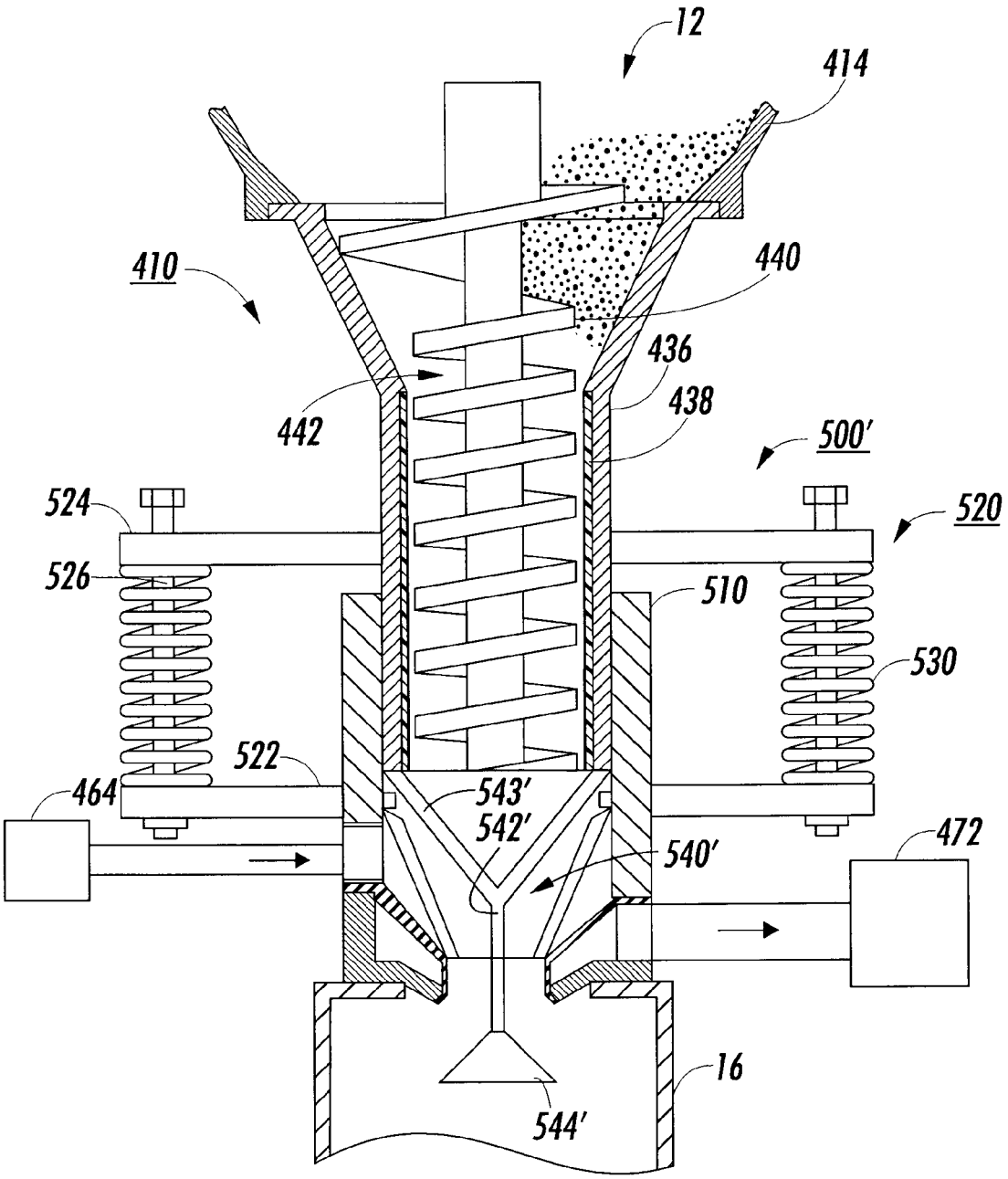
FIG. 17 is a cross-sectional schematic view of the embodiment of the invention shown in FIG. 15, with the mechanical valve in the open position.

The invention shown in FIGS. 16 and 17 are similar to that shown in FIGS. 14 and 15, however, rather than having flow control device 540 attached to the end of the particulate conveyor 440, flow control device 540' is fixed with respect to tube 436. Like numbers indicate the same elements as described earlier with respect to FIGS. 14 and 15.

FIG. 16 shows mechanical valve 500' in the closed position, and is similar to the mechanical valve of FIG. 14, except for the flow control device 540'. In this embodiment, flow control device 540' is fixed with respect to tube 436, that is, it is not attached to the conveyor. Flow control device 540' includes flow control support 542' which includes mounting member 543'. Preferably mounting member 543' has three support braces which are sufficiently narrow in the horizontal plane to not impede the flow of particulate material and wider in the vertical plane for strength, however mounting member 543' may take any form which allows particulate material to pass through it while fixedly supporting flow control member 544' with respect to tube 436.

FIG. 17 shows mechanical valve 500' with flow control device 540' in the open position. Flow control member 544' is spaced a sufficient distance from mounting member 543' such that sliding nozzle assembly 510 may be moved upwardly which causes flow control member 544' to disengage nozzle assembly allowing particulate material to flow through tube 436 and into container 16. The conical shape of flow control member 544' allows for even dispersion of particulate material towards the outer inside edges of container 16, rather than having the particulate material form a mound in the container during the supplying operation which occurs in the absence of flow control member 544'. Having flow control member 544' fixed in this manner solves the particulate dribbling problem between supply operations and enables particulate material 12 to be dispersed evenly in container 16 without aeration. This embodiment eliminates potential problems with having a rotating flow control member such as potentially damaging large inertial and vibration forces that could bend particulate conveyor 440 due to speeds of up to 3,000 RPM, aeration of particulate material which negatively affects the amount of particulate material container 16 can accommodate, or having a particulate conveyor 440 may be slightly bent so an attachment may not be perfectly vertical which could cause flow control member 544' to seat improperly and leak particulate material.

The present invention is applicable to many particulate feed, discharge, and fill operations, for example, toner fill operations and reliably combining toner and the like constituents in for example, pre-extrusion and extrusion operations. Thus, the receiver member can be selected from, for example, an extruder, a melt mixing device, a classifier, a blender, a screener, a variable rate toner filler, a bottle, a cartridge, a container for particulate toner or developer materials, and the like static or dynamic particulate receptacles. It is readily appreciated that the present invention is not limited to toner and developer materials, and is well suited for any powder or particulate material, for example, cement, flour, cocoa, herbicides, pesticides, minerals, metals, pharmaceuticals, and the like materials.

The method and apparatus of the present invention allow particulate materials including toners to be dispensed, mixed, and transported more accurately and more rapidly than prior art systems and can also insure that, for example, a melt mix apparatus or a toner container is filled accurately, quickly, cleanly, completely, and in proper proportion.

The method and apparatus of the present invention provides toner/developer cartridge fills, for example, with magnetic toner materials, that are substantially complete, that is, to full capacity because the fill apparatus enables transport of a dense toner mass with a high level of operator or automatic control over the amount of toner dispensed. Completely filled toner cartridges as provided in the present invention render a number of advantages, such as enhanced customer satisfaction and enhanced product perception, reduced cumulative cartridge waste disposal since there is more material contained in the filled cartridges, and reduced shipping costs based on the reduced void volumes. The particulate volume that can be filled into the containers is approximately constant, that is the same amount of fill into each container, for example, with a fill weight variance of less than about 0.1 to about 0.2 weight percent. The present apparatus and method can fill containers substantially to full capacity with little or no void volume between the toner mass and the container and closure. The containers can be filled, for example, with from about 10 to about 10,000 grams of particulate material at a rate of about 10 to about 1,000 grams per second, and in embodiments preferably from about 20 to about 525 grams per second. The containers can be reliably filled to within from about 0.01 to about 0.1 weight percent of a predetermined value; preferably to less than about 1 weight percent, and more preferably to less than about 0.1 weight percent of a predetermined target or specification value. A predetermined target specification value is readily ascertained by considering, for example, the volume available, volume variability of containers selected, and the relation of the desired weight fill to available volume. The amount of particulate material dispensed may be set or adjusted in the vicinity of a target value by, for example, regulating the speeds of the auger, for example, using a control algorithm in conjunction with an auger motor control circuit. Auger conveyor speeds can be, for example, from about 500 to about 3,000 revolutions per minute(rpm).

The dispensing of the particulate material from the source, for example, for use in toner or developer filling and packaging operations, it is preferred to dispense and fill by weight or gravimetrically. Alternatively, the dispensing of the particulate material from the source can be selected to be both continuous and discrete, for example, for use in toner extrusion or melt mixing applications.

In recapitulation, a high speed toner filler for developer material has been described as an improved method for maximizing toner flow for filling toner containers with small apertures. This method allows toner to be moved more accurately and rapidly than prior art systems and also insures that the toner container is filled quickly, completely and cleanly.

It is, therefore, apparent that there has been provided in accordance with the present invention, a high speed particulate material supply operation that fully satisfies the aims and advantages hereinbefore set forth. While this invention has been described in conjunction with specific embodiments, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for moving a supply of particulate material from a hopper, comprising:

a conduit operably connected to the hopper and extending downwardly therefrom, the conduit adapted to permit a flow of particulate material therewithin, the particulate material in the hopper having a hopper bulk density;

a nozzle assembly operably connected to the conduit and extending downwardly therefrom, the nozzle assembly having a nozzle assembly inlet and a nozzle assembly outlet, a porous nozzle within the nozzle assembly, the porous nozzle defining an inlet thereof for receiving particulate material from the conduit and defining an outlet thereof for dispensing particulate material from the porous nozzle, the inlet defining an inlet cross sectional area and the outlet defining an outlet cross sectional, the inlet cross sectional area being larger than the outlet cross sectional area, and defining an inner periphery thereof;

a layer of air between the inner periphery and the flow of particulate material, the layer of air being supplied by a compressed air source, wherein the layer of air reduces the friction between the particulate material and inner periphery, the particulate material having an exit bulk density as it leaves the nozzle assembly outlet; and a conveyor located at least partially within the conduit, the conveyor assisting in providing the flow of particulate material, wherein the dimensions of the porous nozzle are selected so as to provide a ratio of the inlet cross sectional area to the outlet cross sectional area and the layer of air is controlled such that the flow of particulate material does not seize as it progresses through the nozzle assembly during particulate supplying operations and the hopper bulk density and exit bulk density are substantially the same; and a mechanical valve for controlling the flow of particulate material from the nozzle assembly.

2. An apparatus as claimed in claim 1, wherein the mechanical valve comprises:

a flow control device having a flow control support that extends through the nozzle assembly and including a flow control member at its terminal end, wherein the flow control member seals the nozzle assembly thereby blocking the flow of particulate material from the nozzle assembly between supplying operations.

3. An apparatus as claimed in claim 2, wherein the nozzle assembly is part of the mechanical valve and is slidably supported with respect to the conduit, wherein the nozzle assembly slides upwardly to an open position, thereby unblocking the nozzle assembly from the flow control member and the nozzle assembly slides downwardly to a closed position, thereby sealing the nozzle assembly with the flow control member.

4. An apparatus as claimed in claim 2, wherein the flow control member is conical in shape.

5. An apparatus as claimed in claim 2, wherein the flow control device is attached to the conveyor.

6. An apparatus as claimed in claim 5, wherein the particulate conveyor is an auger.

7. An apparatus as claimed in claim 2, wherein the flow control device is fixed with respect to the conduit.

8. An apparatus as claimed in claim 7, wherein the flow control device includes a flow control mounting member which permits particulate material to flow therethrough.

9. An apparatus as claimed in claim 7, wherein the conveyor is an auger.

10. An apparatus as claimed in claim 1, the nozzle assembly further comprising:

a vacuum port for engaging a vacuum source located near the nozzle assembly outlet, the vacuum source continuously operating during the supplying operation.

11. An apparatus as claimed in claim 1, wherein the particulate material particle size ranges from about 2 to about 50 microns.

12. A method of supplying a predetermined amount of particulate material from a hopper, comprising:

locating a conduit to extend from the hopper, the particulate material in the hopper having a hopper bulk density;

conveying with a conveyor the particulate material in the hopper toward a nozzle assembly attached to the conduit, the nozzle assembly having a porous nozzle with an inlet cross sectional area defining an inlet cross sectional area and an outlet defining an outlet cross sectional area and the porous nozzle having an inner periphery thereof;

sizing the inlet cross sectional to be larger than the outlet cross sectional area;

applying an air boundary to the inner periphery of the porous nozzle to increase the compression ratio of the porous nozzle such that the flow of particulate material does not seize as it progresses through the nozzle assembly;

dispensing particulate material through the conduit with the conveyor through the nozzle assembly during a supplying operation, the particulate material having an exit bulk density as it leaves the nozzle assembly, wherein the particulate material hopper bulk density is substantially the same as the exit bulk density; and controlling the flow of particulate material from the nozzle assembly with a mechanical valve.

13. The method as claimed in claim 12, wherein the air boundary layer is continuously applied to the inner periphery of the porous nozzle during the supplying operation and between each supplying operation.

14. The method as claimed in claim 12, wherein controlling the flow of particulate material further comprises:

slidably mounting the nozzle assembly with respect to the conduit.

15. The method as claimed in claim 12, wherein controlling the flow of particulate material further comprises:

sealing the nozzle assembly with a flow control device, the flow control device having a flow control support that extends through the nozzle assembly and including a flow control member at its terminal end, wherein the flow control member blocks the flow of particulate material from the nozzle assembly between supplying operations; and unsealing the nozzle assembly to allow the flow of particulate material from the nozzle assembly during supplying operations.

16. The method as claimed in claim 15, wherein controlling the flow of particulate material further comprises:

sealing the nozzle assembly includes sliding the nozzle assembly downwardly to engage the flow control member; and unsealing the nozzle assembly includes sliding the nozzle assembly upwardly to disengage the flow control member.

17. The method as claimed in claim 16 further comprising, attaching the flow control device to the to the conveyor so that when the conveyor moves, the flow control device moves.

18. The method as claimed in claim 16 further comprising, fixing the flow control device with respect to the conduit so that when the conveyor moves, the flow control device remains fixed.

19. The method as claimed in claim 15 further comprising, shaping the flow control member for even distribution of particulate material.

20. A method of supplying developer material from a hopper, comprising:

extending a conduit from the hopper, the developer material in the hopper having a hopper bulk density;

conveying with an auger the developer material in the hopper toward a nozzle assembly attached to the conduit, the nozzle assembly having a porous nozzle with an inlet cross sectional area and an outlet defining an outlet cross sectional area, the porous nozzle having an inner periphery, wherein the inlet cross sectional area is larger than the outlet cross sectional area;

applying an air boundary to the inner periphery of the porous nozzle to increase the compression ratio of the porous nozzle such that the flow of developer material does not seize as it progresses through the nozzle assembly, wherein the air boundary layer is continuously applied to the inner periphery of the porous nozzle during the supplying operation and between each supplying operation;

supplying developer material through the conduit with the auger through the nozzle assembly during a supplying operation, wherein the auger is sized with respect to the conduit such that the rate at which particulate material travels through the conduit is substantially the same rate at which particulate material exits the nozzle, the developer material having an exit bulk density as it leaves the nozzle assembly, wherein the developer material hopper bulk density is substantially the same as the exit bulk density; and controlling the flow of developer material from the conduit with a mechanical valve, the nozzle assembly being part of the mechanical valve and is slidably supported with respect to the conduit.

* * * * *